US007322906B2

(12) United States Patent
Webber

(10) Patent No.: US 7,322,906 B2
(45) Date of Patent: Jan. 29, 2008

(54) EXERCISE ARM ASSEMBLY FOR EXERCISE MACHINE

(76) Inventor: Randall T. Webber, 1265 Park Row, La Jolla, CA (US) 92037

( * ) Notice: Subject to any disclaimer, the term of this patent is extended or adjusted under 35 U.S.C. 154(b) by 278 days.

(21) Appl. No.: 10/918,150

(22) Filed: Aug. 13, 2004

(65) Prior Publication Data

US 2006/0035764 A1 Feb. 16, 2006

(51) Int. Cl.
*A63B 21/062* (2006.01)
*A63B 21/00* (2006.01)

(52) U.S. Cl. ..... 482/100; 482/137

(58) Field of Classification Search ..... 482/100, 482/136, 137, 139, 97
See application file for complete search history.

(56) References Cited

U.S. PATENT DOCUMENTS 4,629,185 A 12/1986 Amann
4,772,015 A 9/1988 Carlson et al.
4,773,398 A 9/1988 Tatom
4,898,381 A 2/1990 Gordon
4,949,951 A * 8/1990 Deola ..... 482/138
5,344,374 A 9/1994 Telle
D359,326 S 6/1995 Deola
5,437,589 A 8/1995 Habing
5,466,204 A 11/1995 Nearing
5,562,577 A 10/1996 Nichols, Sr. et al.
5,582,564 A 12/1996 Nichols, Sr. et al.
5,597,257 A 1/1997 Habing
5,597,375 A 1/1997 Simonson
5,643,152 A * 7/1997 Simonson ..... 482/100
5,681,247 A 10/1997 Webber
5,683,334 A 11/1997 Webber
5,810,701 A 9/1998 Ellis et al.
5,823,920 A 10/1998 Grider
5,836,858 A 11/1998 Sharff
5,916,072 A 6/1999 Webber
5,967,954 A 10/1999 Habing
5,971,895 A 10/1999 Habing
5,997,447 A 12/1999 Giannelli et al.

(Continued)

OTHER PUBLICATIONS

TuffStuff PL-202 Bilateral Vertical Chest Press, Task Industries, Jan. 1997 advertisement.

(Continued)

*Primary Examiner*—Stephen R. Crow
*Assistant Examiner*—Allana Lewin
(74) *Attorney, Agent, or Firm*—Procopio, Cory, Hargreaves & Savitch LLP

(57) ABSTRACT

An exercise arm assembly has a main arm with a central region having a first pivot connection for connection to a frame of an exercise machine to allow pivoting of the main arm about a primary pivot axis, a first swing arm pivoted to one end of the main arm for pivoting about a first swing arm pivot axis, and a second swing arm pivoted to the opposite end of the main arm for pivoting about a second swing arm pivot axis. Each swing arm has at least one handle spaced from the respective swing arm pivot axis for gripping by a user when performing exercises. The swing arm pivot axes are inclined inwardly towards one another to intersect at a location spaced below the first pivot axis, such that the swing arms automatically swing outwardly into an outward rest position when released.

31 Claims, 28 Drawing Sheets

U.S. PATENT DOCUMENTS

| | | | | |
|---|---|---|---|---|
| 6,004,247 | A * | 12/1999 | Webber | 482/100 |
| 6,030,322 | A | 2/2000 | Webber | |
| 6,080,091 | A * | 6/2000 | Habing et al. | 482/137 |
| D439,941 | S | 4/2001 | Batca et al. | |
| 6,234,941 | B1 * | 5/2001 | Chu | 482/100 |
| 6,238,323 | B1 | 5/2001 | Simonson | |
| 6,394,936 | B1 | 5/2002 | Voris | |
| 6,579,213 | B1 * | 6/2003 | Webber et al. | 482/100 |
| 6,689,023 | B2 * | 2/2004 | Baumler | 482/100 |
| 2004/0029688 | A1 | 2/2004 | Webber et al. | |

OTHER PUBLICATIONS

Nebula Fitness Equipment, Lever Row Swivel Adjustments #4005, catalog 1993.
TuffStuff, TUB49 Upper Body Machine, catalog, 1998.
Polaris, Upper Torso Machines, brochure, 1983, p. 2.
Hoist Fitness Systems, brochure, 1989.
Gym 80, Butterfly with Start Assistance, brochure 1994.
Icarian, Rear Delt/Pec Fly, brochure 1993.
Bodymasters, Pec Contractor Rear Deltoid Machine, brochure, date unknown, p. 11.
Cadex, Chest Press and Fly, advertisement, 1997.
Schnell, pectoral machine (Discs) brochure, date unknown.
Life Fitness Rear Deltoid/Pectoral Fly, brochure, 1997.
Flex,. Deltoid Fly brochure, date unknown.
Linear Stairmaster, brochure, date unknowns.
Pacific Fitness, brochure, 1998.
Paramount, Rotary Chet Press, brochure, 1997.
Paramount, Rotary Chet Press, A.R.T. 4200, brochure, date unknowns.
Corbin Pacific, Chest Press Machine, advertisement *Strength & Conditioning Association Journal*, Apr.-May 1982.
TuffStuff, Muscle IV, brochure, 1986.
Hoist Fitness Systems, CD2900 Rear Deltoid/Pectoral Fly brochure, Jan. 2001.

* cited by examiner

EXERCISE ARM ASSEMBLY FOR EXERCISE MACHINE

BACKGROUND OF THE INVENTION

The present invention relates generally to weight-lifting exercise machines, and is particularly concerned with exercise arms for such machines for use in performing upper body exercises such as pectoral (pec) fly, rear deltoid, chest press, and mid row exercises.

Originally, upper body exercises were performed using hand-held weights. For pec fly and rear deltoid exercises, independent weights known as dumbbell were held in each hand. Chest press and mid row exercises could be performed using either a barbell, where a single weight is controlled by both hands, or two separate dumbbell. In a pec fly exercise, the exerciser would lie on a bench facing upwards with a weight in each hand, arms extended out to the side, and palms facing up, with the elbows bent. The exerciser would then lift the weights to bring the dumbbell together over their body with a slight arcing or elliptical pattern to the movement. For a rear deltoid exercise, the exerciser would lie face down on a bench with a dumbbell in each hand, with their arms straight down, palms facing each other, and elbows slightly bent. Keeping the arms in the same bent position, the exerciser would lift the weights until their arms were straight out to the side.

In order to perform a chest press using dumbbell, the exerciser would lie face up on a bench with a weight in each hand, arms to each side with elbows bent and hands close to the chest. The exerciser would then push the weights up, bringing the dumbbell together over their body in a slight arcing or elliptical movement. In a mid row exercise, the exerciser would bend over at the waist with a weight in each hand, arms hanging straight down, and hands together with the palms facing each other. Staying in the bent position, the user would then pull the weights up to chest level with a slight arcing or elliptical pattern to the movement.

Various exercise machines have been designed in order to duplicate one or more of the free weight, upper body exercises such as pec fly, rear deltoid, chest press, and mid row. Typically, these machines have pivoted arms linked to an exercise resistance. There are several problems in attempting to combine two or more of the upper body exercises with a single exercise arm assembly, due to the different motions which must be accommodated for each exercise.

The earliest pec fly machine had two independent exercise arms pivotally mounted on a frame above the user's head. The arms were generally L-shaped with a pivot shaft attached to the end of one leg of the L and a pad or roller attached to the other leg. The user sat on a seat mounted on the frame with their upper arms parallel to the floor and forearms bent 90 degrees at the elbow. With their forearms resting against the pads, the user rotated their arms forward until they came together. Since the exercise arms had only one pivot, they could only move in a concentric or circular pattern, and the arms were non-adjustable for different users. In order to perform a rear deltoid exercise on this machine, a user would sit facing the rear of the machine, placing their elbows on the pads, and trying to rotate their arms rearwards. This was a cramped, uncomfortable position which did not allow a full range of motion, and was of marginal value from an exercise point of view.

In view of the limitations of the earliest pec fly machine in performing rear deltoid exercises, a separate rear deltoid machine was designed, which allowed users to fully extend their arms and perform a full range of exercise motion. This machine had a second pivot to pivotally mount a handle at the bottom of the second leg of the L-shaped arm. The handle was T-shaped, with the bottom of the T pivotally secured to the exercise arm and the grip portion of the handle comprising the top of the T and oriented vertically. This machine could also be used for pec fly exercises, and had the advantage that the user's hands were placed in a more natural position.

A combination pec fly/rear deltoid machine encounters difficulties due to the fact that the two exercise movements are different. In the rear deltoid exercise, the natural position for the arms is fairly straight with a slight bend or break at the elbows throughout the entire movement, which is circular or concentric. In a pec fly exercise, the natural movement is more elliptical, since the starting width of the exerciser's grip is closer to their body at the beginning of the exercise than at the end. In order to function properly for both exercises, the original combination machines had to have a T handle short enough to provide the necessary pre-stretch for a rear deltoid exercise. This handle was not quite long enough to provide the swing necessary for the proper elliptical arc on a pec fly exercise.

In later machines, the rotating handle was eliminated and replaced with a swing arm, which hinged at the elbow of the L-shaped exercise arm. The second pivot was perpendicular to the first pivot at the top of the exercise arm, and at the same elevation as the first pivot. Pads or handles were mounted to the swing arms to engage the user's forearms or hands.

Various machines have also been designed for performing press type exercises. U.S. Pat. No. 5,916,072 of Webber describes an exercise apparatus with an exercise arm assembly for performing chest press and mid row exercises. A pair of swing arms are pivoted at opposite sides of a U-shaped, pivoted yoke. Various alternative configurations are described, including some in which the swing arms have two pivoting sections. All the designs have parallel pivots and cannot provide a converging exercise movement. This design will not work for a combination machine with pushing/pulling converging movement.

U.S. Pat. No. 5,181,896 of Jones describes an exercise machine for performing incline press exercises which has independent, fixed arc, converging exercise arms. This can be used for only one type of exercise. U.S. Pat. No. 5,643,252 of Simonson describes independent, single piece exercise arms that travel in a fixed arc and can be used for performing chest press exercises. The handles are rigidly secured to the exercise arms.

U.S. Pat. No. 6,579,213 of Webber et al. describes an exercise arm assembly having a main arm pivoted to the exercise machine frame, a swing arm pivoted to the main arm, and a handle pivoted to the swing arm, with each pivot axis being perpendicular to the other two to form a perpendicular, tri-pivot arm system. This provides a multi-dimensional exercise arm which can perform both concentric and eccentric exercise movements. The pivot mount of the handle, together with the other two pivots, provides the user with an unlimited number of possible hand positions.

U.S. Pat. No. 6,689,023 of Baumler describes a multi-exercise gym system which has a press arm having a main arm and right and left press handles. The main arm is pivotally connected to the frame, and each press handle is pivotally connected to the main arm. The range of pivot of each press handle is restricted by a restrictor pin fixed to each press handle which engages in a slot in a restrictor plate on the main arm, and which allows for converging exercise motions.

SUMMARY OF THE INVENTION

It is an object of the present invention to provide a new and improved exercise arm assembly for an exercise machine which can be used for different types of upper body exercises.

According to the present invention, an exercise arm apparatus is provided which comprises a main arm having a central region and opposite ends, the central region having a first pivot connection for connection to a frame of an exercise machine to allow pivoting of the main arm about a first pivot axis, a first swing arm pivoted to one end of the main arm for pivoting about a first swing arm pivot axis, a second swing arm pivoted to the opposite end of the main arm for pivoting about a second swing arm pivot axis, each swing arm having at least one handle spaced from the respective swing arm pivot axis for gripping by a user when performing exercises, and the swing arm pivot axes being inclined inwardly towards one another to intersect at a location spaced below the first pivot axis.

In an exercise machine of an exemplary embodiment of the invention, the frame has an upper support to which the main arm is pivoted, with the swing arms suspended downwardly from the upper support on opposite sides of a seat facing the forward end of the machine, and the main arm is linked to a suitable exercise resistance such as a weight stack or the like. The swing arm pivot axes are inclined inwardly towards the seat and may also be angled forwardly. The inward and forward angle of the swing arm pivots forces the swing arms to automatically fall outward into a rest position when released. Stops may be provided at the pivot junction between the main arm and each swing arm for holding the swing arms in the rest position. This arrangement keeps the swing arms out of the way when the user is performing other exercises that do not involve the main arm, and also makes entering and exiting the machine easier.

The orientation of the swing arm pivot axes also forces the swing arms to drop in elevation as they pivot from the inward to the outward position and moves the handle to the proper starting height for press and fly exercises. The arrangement creates a greater handle elevation change during an exercise movement, which more closely duplicates the desired "chest to chin" movement performed with free weights, and involves more chest muscles.

The main arm may be a single, generally U-shaped member which is pivotally connected to the main frame of the machine at its center, or may be two separate arms each pivotally connected to the main frame at one end for independent pivoting movement about a common pivot axis. One or two handles may be provided on each side of the exercise arm assembly, with one handle secured to the swing arm and the second handle secured to the main arm, the swing arm, or a mounting bracket forming part of the pivotal connection between the swing arm and main arm. The swing arm handle may be fixed, or may be pivotally connected to the swing arm for rotation about a handle axis to provide different hand positioning for the user.

The main arm in the exemplary embodiment has a downwardly angled bend on each side of the central portion, and end portions that angle inwardly towards one another, so that each swing arm hinges to the main arm below the level at which the main arm pivots to the frame. The swing arms are free swinging and are not affected by the resistance, nor do they affect the resistance.

The rotation of each swing arm about its respective pivot axis may be limited by a range limiting system, including at least one end stop defining an outer rest position of the swing arm. A second end stop may be provided to define an inner end position, or there may be no restriction on inward movement. In one embodiment of the invention, each swing arm has a slotted receiving plate which allows the swing arms to be locked in a fixed position relative to the main arm to provide a more traditional "fixed" motion or barbell like exercise, or to hold the swing arms in place while other exercises are performed on the machine which do not involve the swing arms. Rather than a single fixed position, a plate with a plurality of holes may be provided on the swing arm, and a pull pin may be provided on the main arm for releasable engagement in a selected hole. In this alternative, the swing arm does not pivot freely during exercise but instead is designed to be used in multiple fixed positions. The plate may have end stops which limit the inward/outward range of the swing arm when the pull pin is released.

In one exemplary embodiment of the invention, a locking pull pin is mounted on each end of the main arm, and a slotted receiving plate is provided on each swing arm with a slot for receiving the pull pin in a predetermined fixed position of the swing arm. The pull pin is moveable between a retracted position in which the swing arm can rotate freely about its pivot axis, and an extended position for engagement with the slot. The receiving plate may have guide edges providing an automatic ramping capability for the pull pin when in the engaged position. When the pull pin is moved into the extended position and the swing arm is positioned with the slot located either inward or outward of the pull pin position, the swing arm can be swung towards the central locking position, and the pull pin will contact the guide edge of the receiving plate, which will guide the pull pin into the slot, automatically locking the swing arm in a stationary, fixed exercise position.

The exercise arm assembly of this invention has swing arms which are pivoted at an orientation designed to provide a converging, wide to narrow movement pattern, allowing the user to perform a dumbbell-like exercise. The swing arms may also be designed to lock in place so as to provide a more traditional barbell-like exercise. The pivotal movement provides a user defined motion which allows the exerciser to direct their hands in the desired exercise path. The multi-position handles at the ends of the swing arms provide proper hand positioning for both press and fly exercises, while the additional handle on each side allows for different types of exercise such as mid-row exercises. The compound angle (inward and forward) of the swing arm pivot forces the arms to fall outward automatically into a rest position when released and not in use. This allows the swing arms to stay out of the way when an exerciser is entering or exiting the machine, or performing additional exercises not involving the swing arms.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
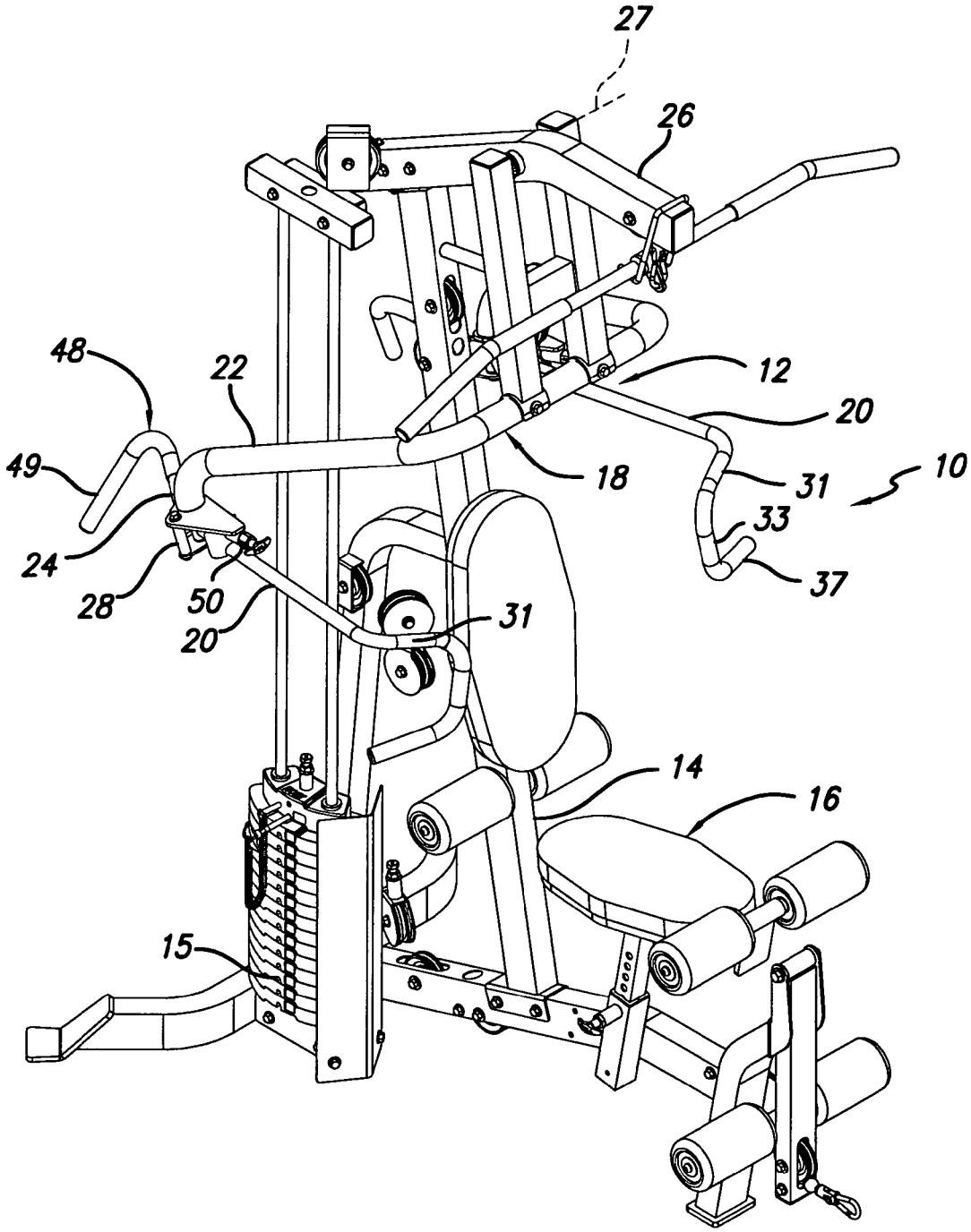
FIG. 1 is a perspective view of an exercise machine having an exercise arm assembly according to a first embodiment of the invention, with the swing arms shown in a locked position.
Figure 2:
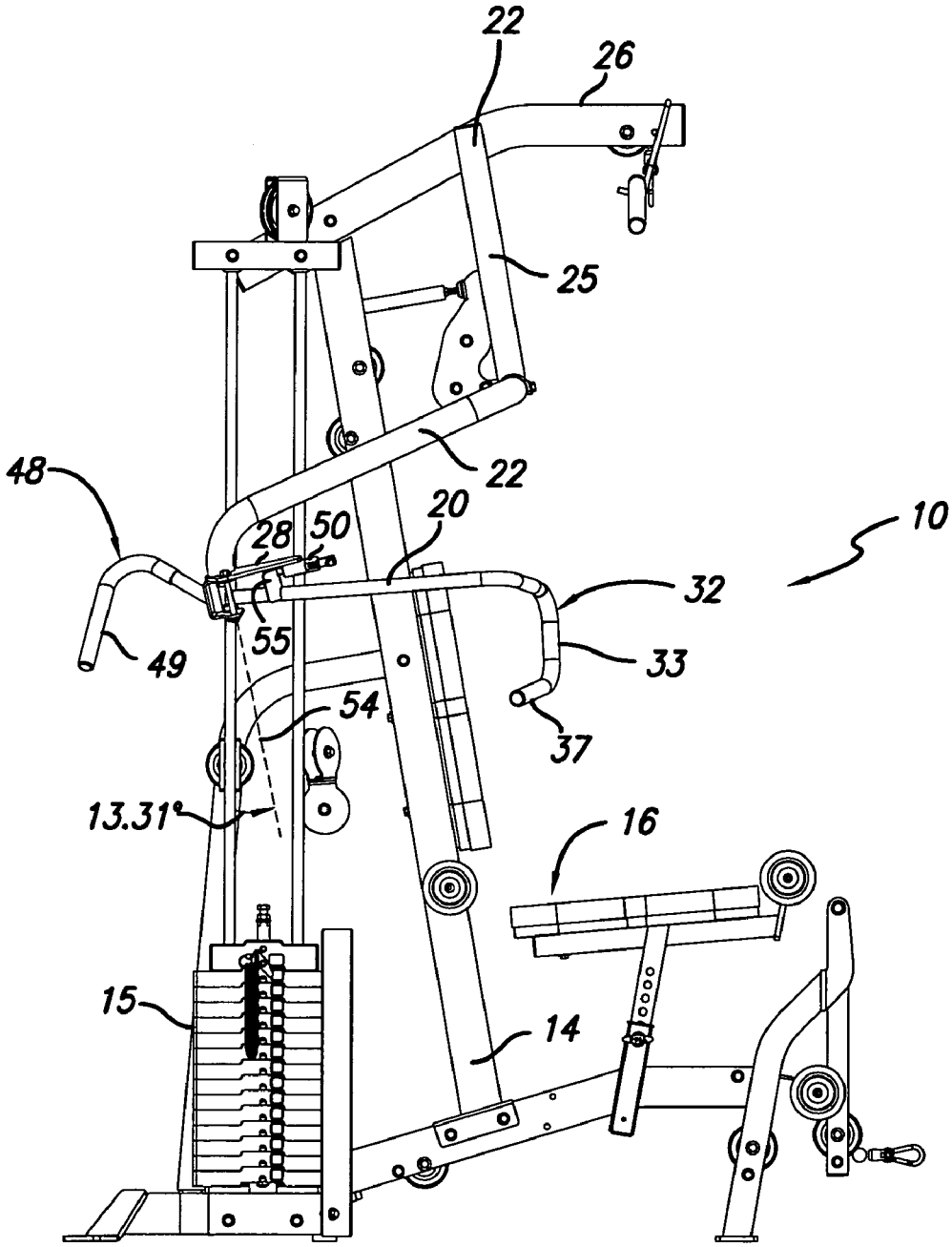
FIG. 2 is a side view of the machine of FIG. 1.

FIGS. 1, 2 and 11 to 14 of the drawings illustrate an exercise machine 10 having an exercise arm apparatus or assembly 12 according to a first embodiment of the present invention, while FIGS. 3 to 10 illustrate details of the exercise arm apparatus 12. FIGS. 1 and 2 illustrate the arm apparatus 12 mounted in an overhead position on the frame 14 of an exercise machine 10. The exercise arm apparatus 12 is linked to an exercise resistance on the frame, such as a weight stack 15, via a conventional cable and pulley linkage, only part of which is illustrated in the drawings. A seat 16 comprising a seat pad and back pad is also mounted on the frame in a forwardly facing position for supporting a user when performing exercises using the exercise arm assembly 12 or other exercise stations provided on the machine. The user may sit on the seat facing forwardly or rearwardly, depending on the type of exercise to be performed.

Figure 4:
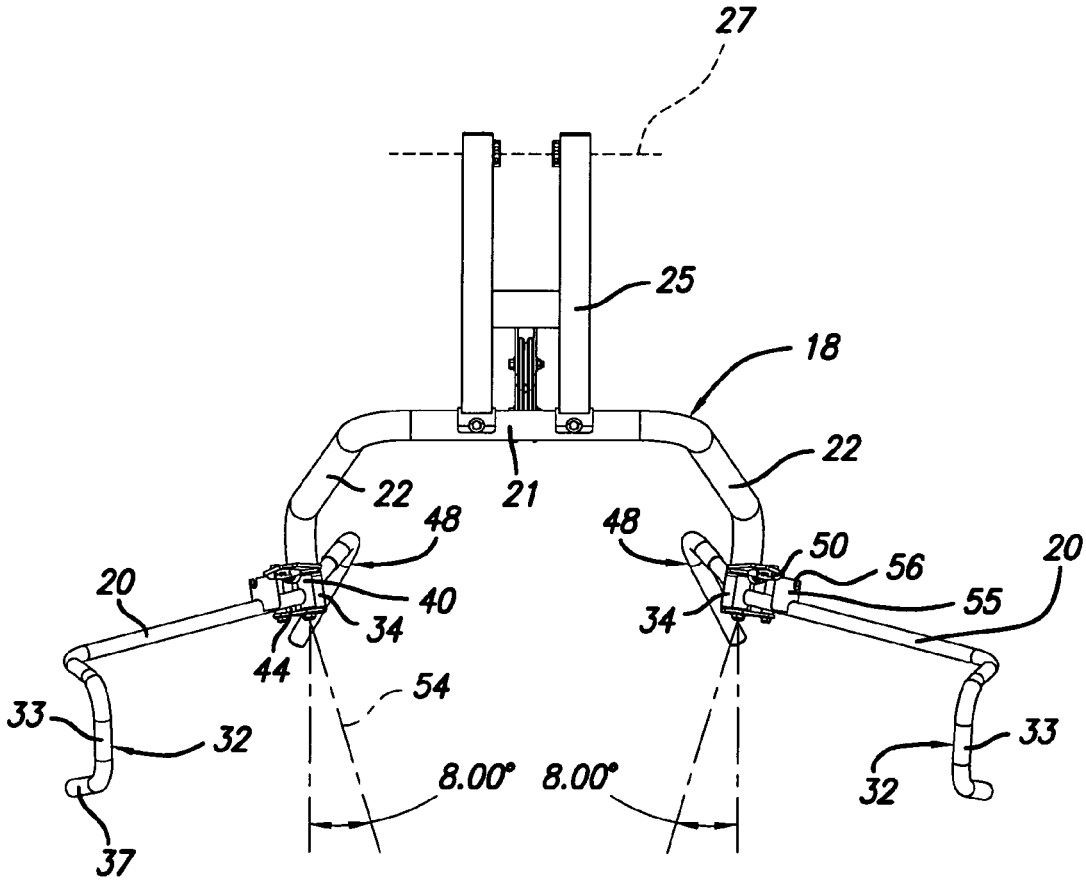
FIG. 4 is a front elevation view of the exercise arm assembly, with the swing arms in an outer rest position, and illustrating the inward angle of the swing arm pivots.

The arm assembly 12 basically comprises a generally U-shaped main arm 18 and a pair of swing arms 20 pivoted to the respective ends of the main arm. The main arm has a central portion 21, opposite arm portions 22 which are angled rearwardly and downwardly, and end portions 24 which are angled slightly inwardly towards one another, as best illustrated in FIG. 4. A hanger bracket 25 is secured at one end to the central portion 21 of the main arm and is pivotally connected to an upper strut 26 of the machine frame at its opposite end for pivoting about a first or primary pivot axis 27.

Figure 3:
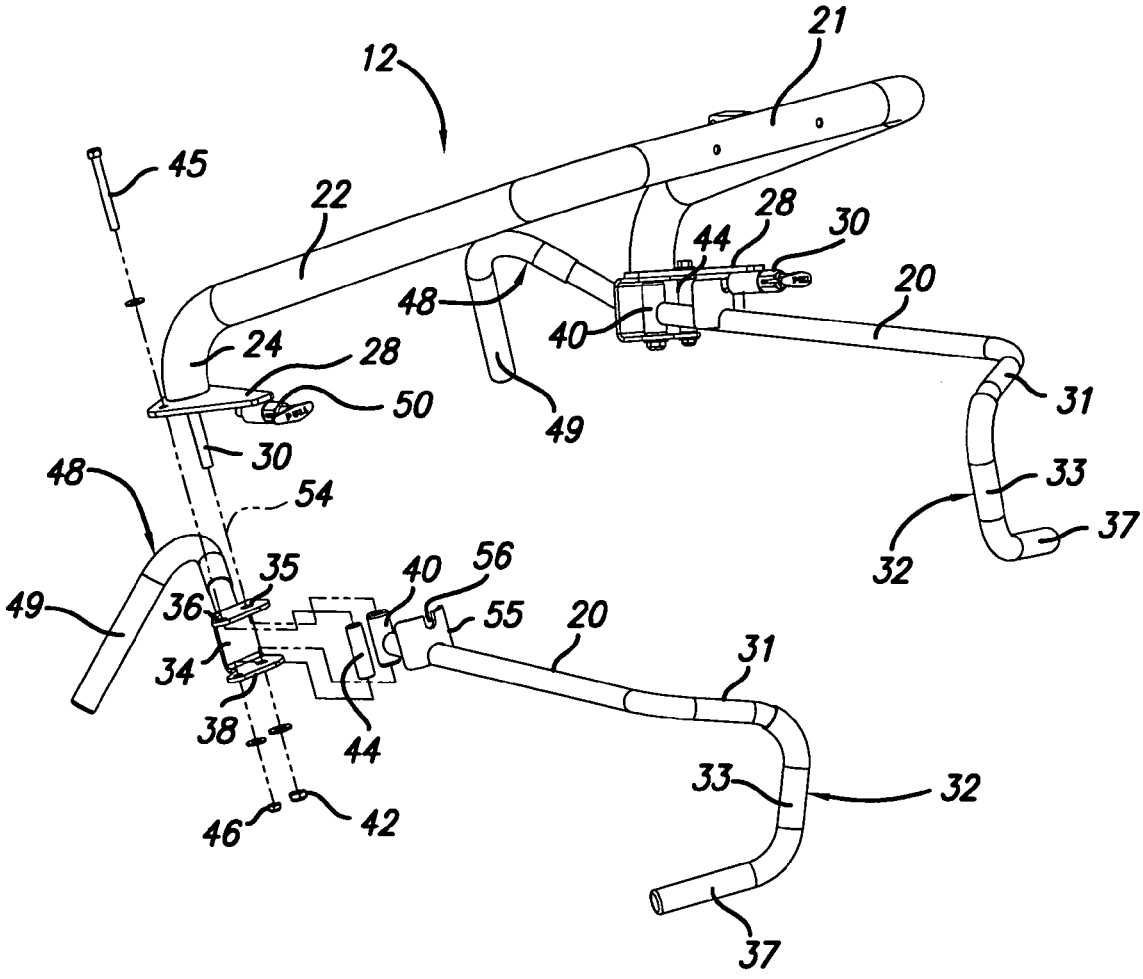
FIG. 3 is a perspective view of the exercise arm assembly of FIG. 1, with the components of the arm on one side in an exploded, separated view.

As best illustrated in FIG. 3, an end plate 28 is secured to each end of the main arm, and a pivot shaft 30 protrudes downward from each end plate 28, away from the respective ends of the main arm and at a converging or inwardly directed angle. The pivot shafts 30 provide for the pivot connection between the swing arms 20 and the main arm 18. The main arm is pivotally mounted to the frame of the exercise machine such that the two pivot shafts angle forward when the exercise arm is in the rest position, as indicated in FIG. 2, and also angle inwardly towards one another, as indicated in FIG. 4. As seen in FIG. 4, the pivots 30 are angled 8 degrees inward relative to the vertical or gravitational axis, or to a direction perpendicular to the main pivot axis 27. The pivots are also angled forwardly off perpendicular or vertical by about 13⅓ degrees, as can be seen in FIG. 2. As can be seen in FIG. 4, the swing arm pivot axes 54 will intersect at a location spaced below the main arm pivot axis 27.

Each swing arm 20 has receiving means at one end for pivotal connection to a respective pivot shaft 30, and a handle or grip 32 at the opposite end. The handle 32 is designed to provide multiple position hand placement for the user. As best illustrated in FIGS. 1 and 3, the swing arm 20 has a generally straight portion extending from the pivot shaft 30, and the handle 32 is formed integrally with the swing arm via a series of bends to form an inwardly bent portion 31, a generally downwardly bent portion or first grip 33, and a generally outwardly bent portion or second grip 37. The user can choose to grasp either the first, generally vertical grip 33 or the second, generally horizontal grip 37, depending on which is the most comfortable for the exercise being performed. Of course, each grip will change in orientation as the main arm and/or swing arms are rotated about their respective pivot axes, as can be seen from the drawings illustrating the apparatus with the swing arms and/or main arms rotated into different positions.

As illustrated in the exploded view of FIG. 3, a pivot mounting bracket 34 is secured to each end plate 28. The mounting bracket has two pairs of aligned holes 35,36 in end flanges 38, and the pivot shaft 30 extends through one pair of holes 35 and through a pivot sleeve 40 secured to the end of the respective swing arm, with the end of the pivot shaft secured by nut 42. Pivot sleeve 40 is rotatably engaged over shaft 30. A stop pin 44 is secured between the other pair of aligned holes 36 via a bolt 45 which extends through the holes 36 and stop pin and is secured at its end by a nut 46. A second, fixed handle or grip 48 is secured to the outer or rear face of the pivot mounting bracket 34, so as to extend away from the swing arm as illustrated in FIG. 2. Handle 48 may be used to perform additional exercises such as mid row exercises, and has a generally downwardly angled grip portion 49.

A locking pull pin 50 is mounted on each end plate 28 facing towards the pivot shaft 30. The pull pins 50 are of a type commonly used in the exercise machine industry and may be locked in an open or disengaged position in which a spring loaded plunger is retracted. When the pull pins 50 are unlocked or disengaged, the spring loaded plunger 52 (see FIG. 9) protrudes outwardly towards the swing arm pivot axis 54. An arcuate receiving plate 55 is mounted on each swing arm at a location spaced from pivot sleeve 40. Each plate 55 has an upwardly facing slot 56 designed to receive the spring loaded plunger 52 of the pull pin 50 when the slot is aligned with the pull pin, which defines a predetermined locked position of the swing arm, as will be described in more detail below.

Figure 5:
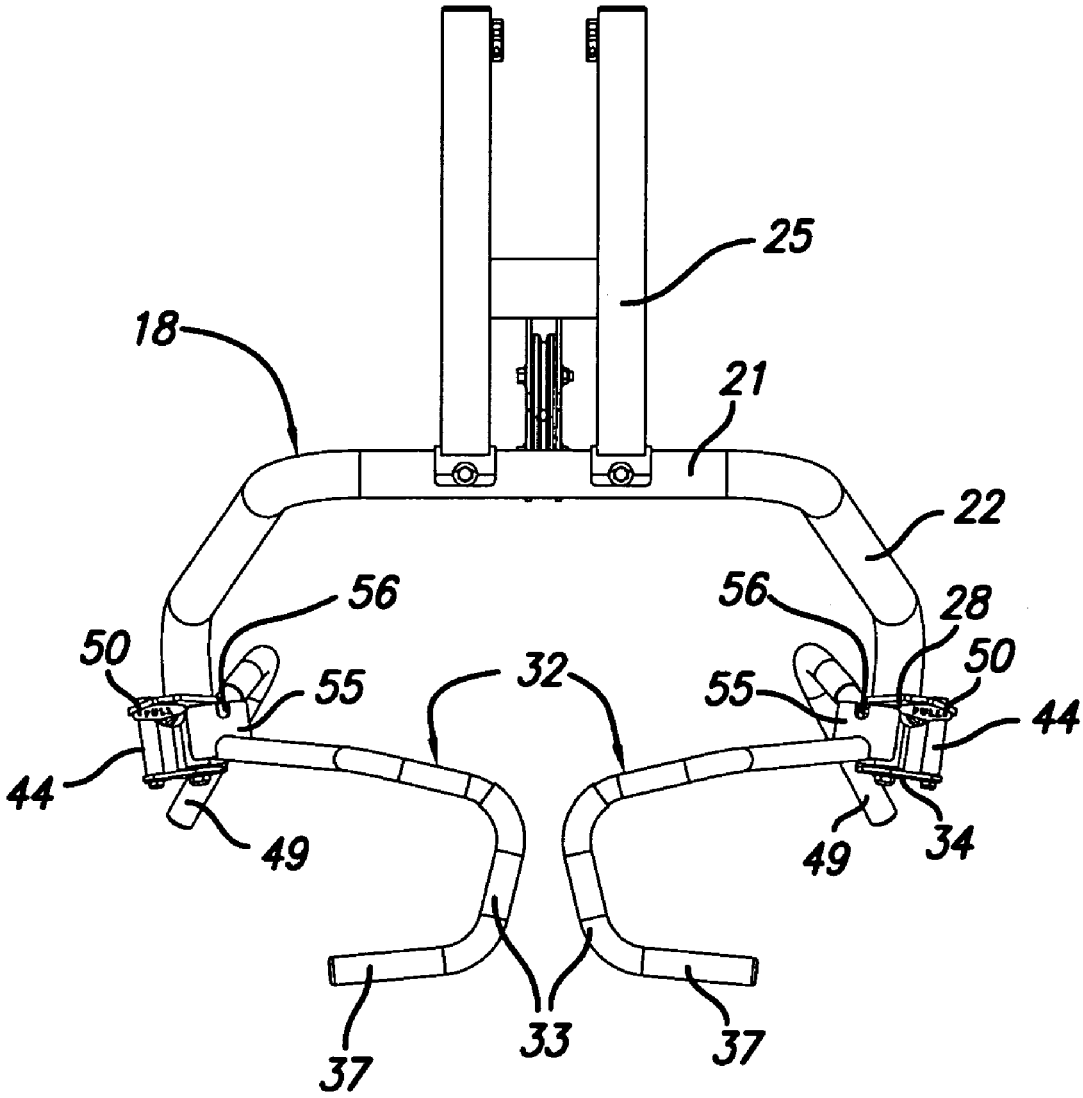
FIG. 5 is a front elevation view of the exercise arm assembly, with the swing arms in an inward position.
Figure 6:
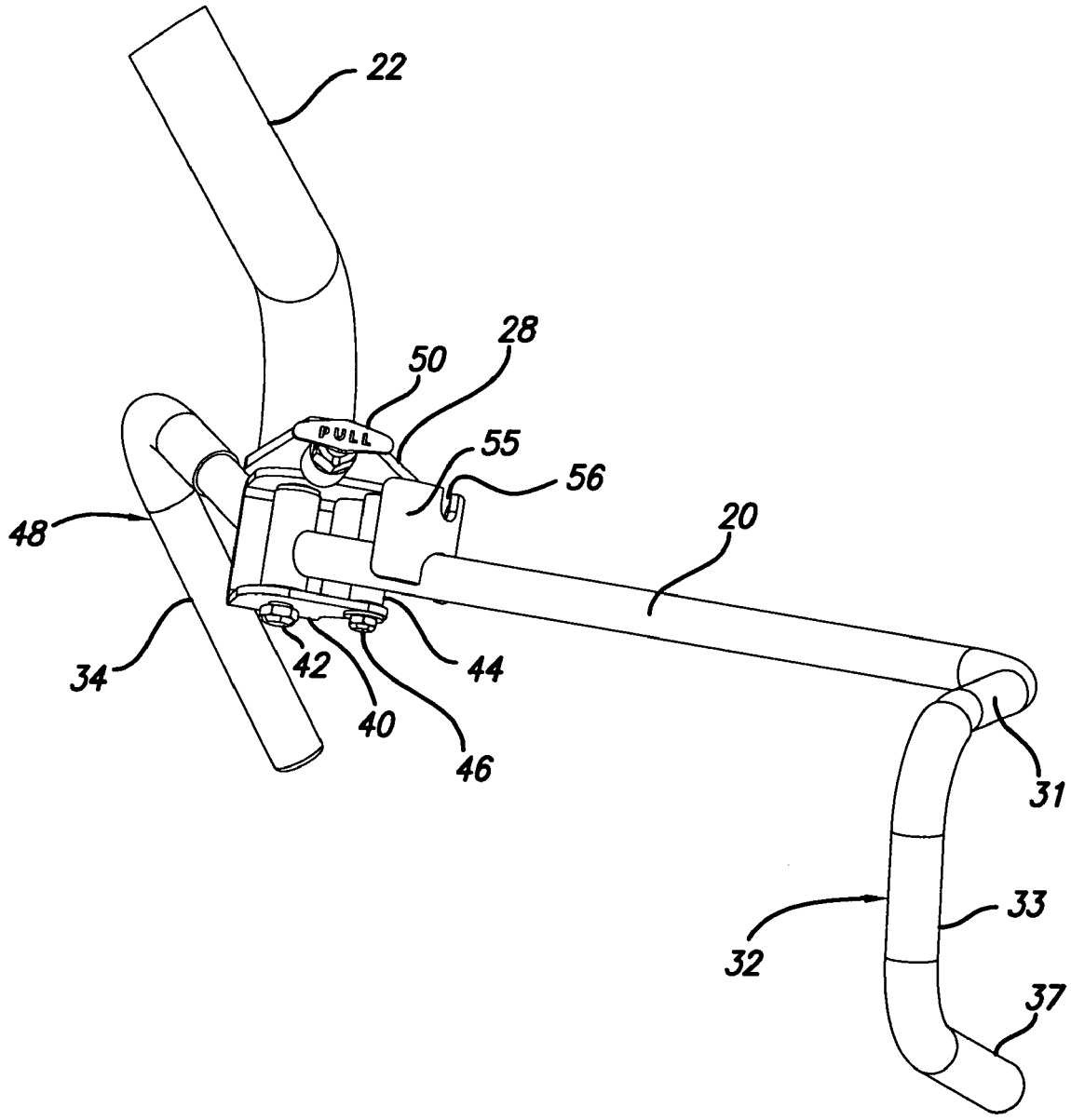
FIG. 6 is an enlarged view similar to FIG. 5 of one side of the arm assembly with the swing arm in the outward position.
Figure 7:
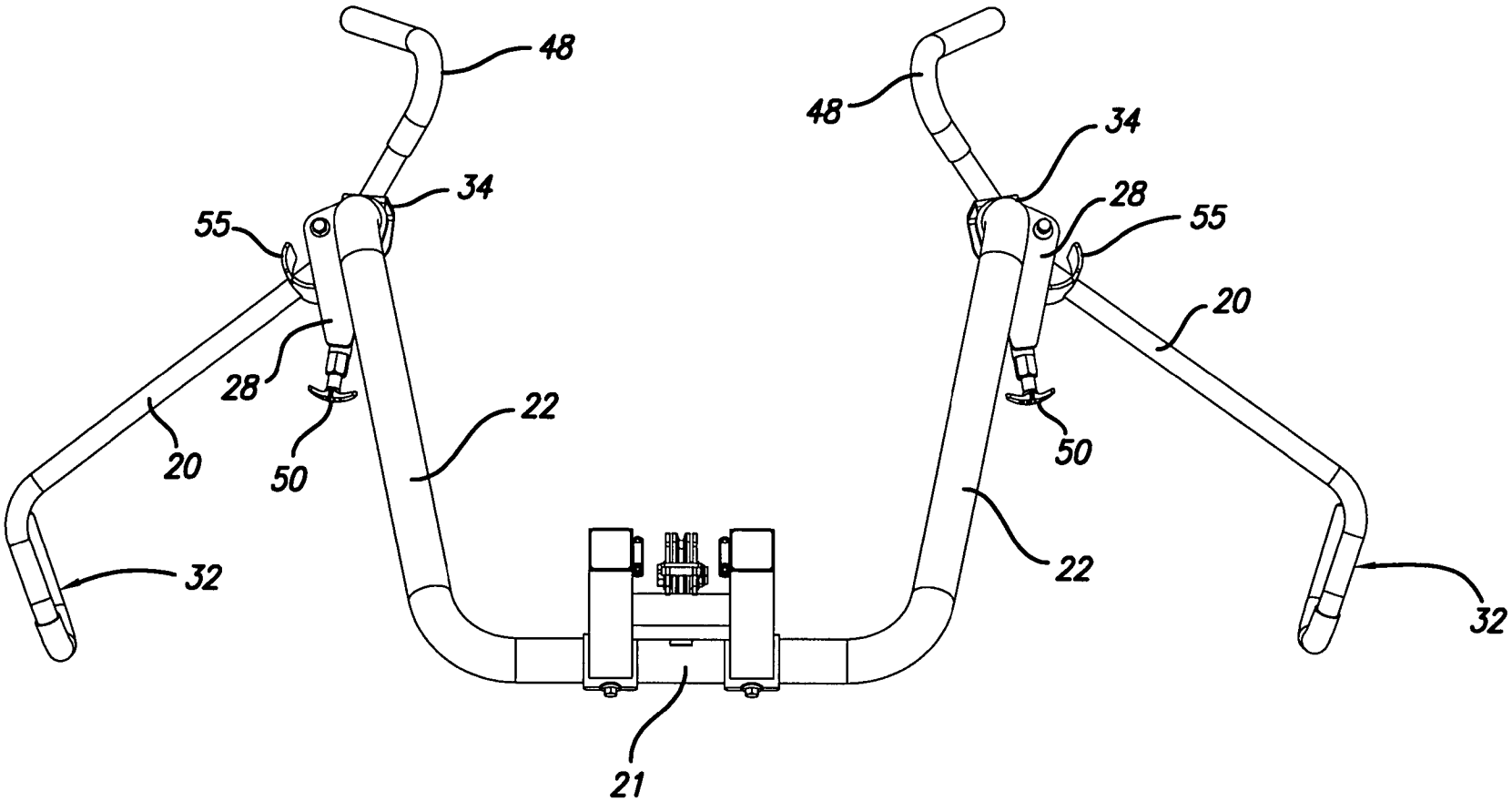
FIG. 7 is a top plan view of the exercise arm assembly with the swing arms in the outward position.
Figure 8:
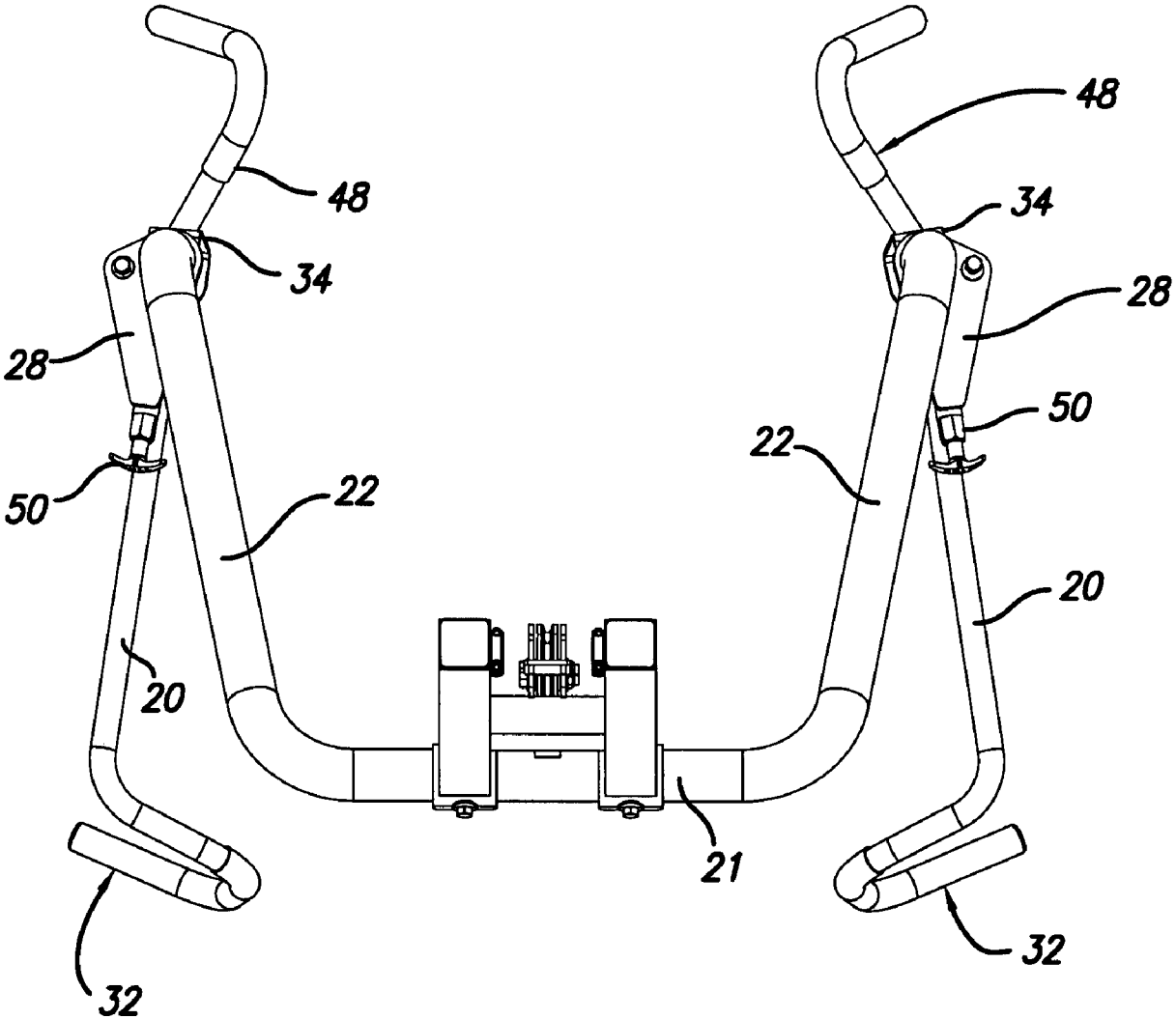
FIG. 8 is a top plan view similar to FIG. 7 illustrating the swing arms in the locked position.

When the plunger 52 is retracted and locked in the retracted position, the swing arm is free to pivot about axis 54 between an outward, rest position against the stop pin 44, as illustrated in FIGS. 4, 6 and 7, and an inward position as illustrated in FIGS. 5 and 8. The inward position of FIG. 5 represents the finish position for both a converging press and a fly exercise. The compound angle (inward and forward) of the swing arm pivots forces the arms to fall outward automatically into a rest position against stops 44 when the arms are released. This ensures that the swing arms stay out of the way of the user when they are entering and exiting the machine, and when they are performing different exercises not using the exercise arm assembly 12. The angle of the pivots also forces the swing arms to drop in elevation as they pivot from an inward to an outward position, and moves the multi-position grip 32 to the proper starting height for both press and fly exercise. The compound angle of the pivots also forces the user's hands to pronate (rotate the thumbs inward towards the body) during the exercise movement, which increases chest muscle involvement when combined with a converging motion.

Figure 11:
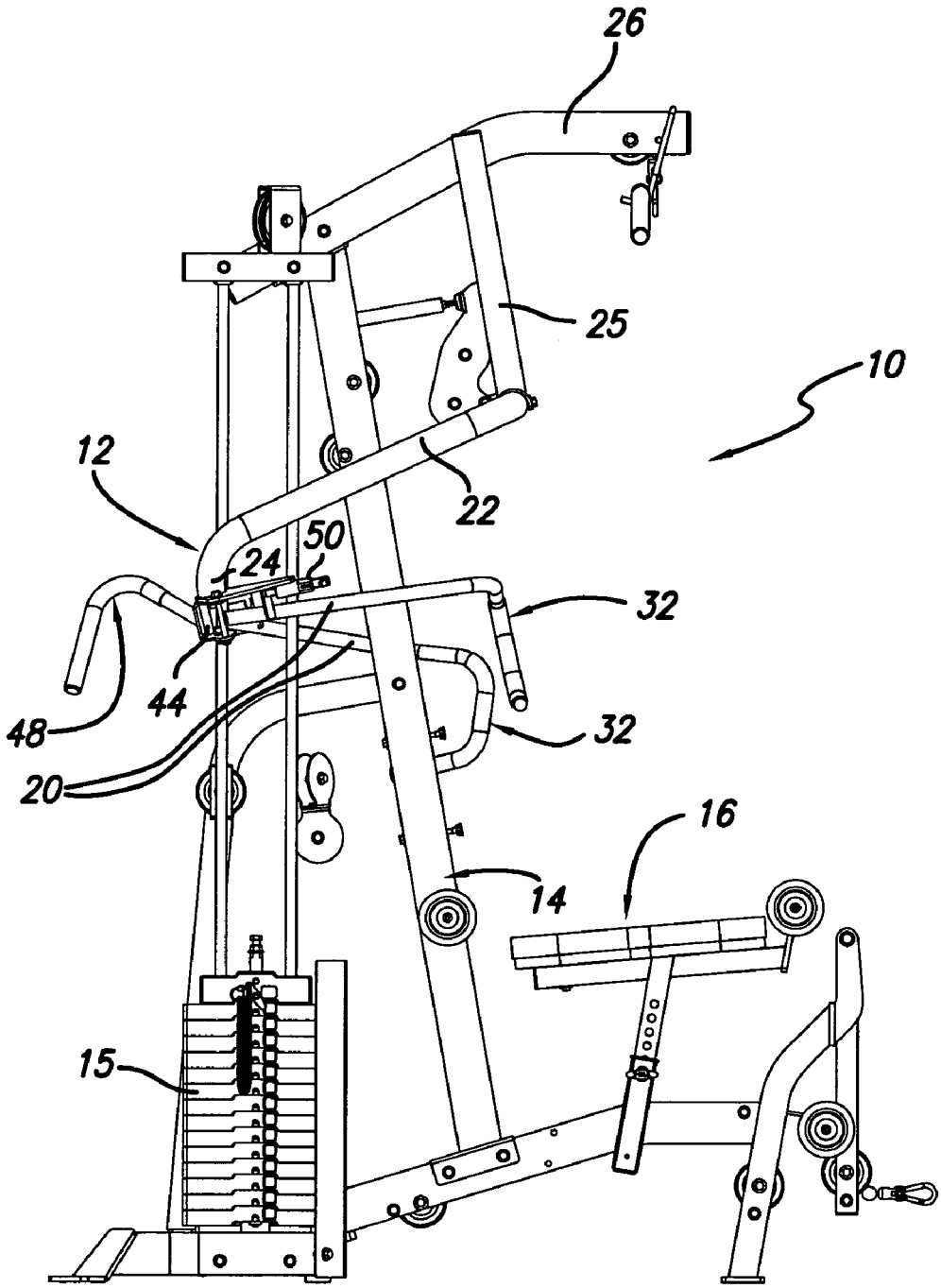
FIG. 11 is a side elevation view similar to FIG. 2, but illustrating one of the swing arms in the inward position and the other swing arm in the outward position.
Figure 12:
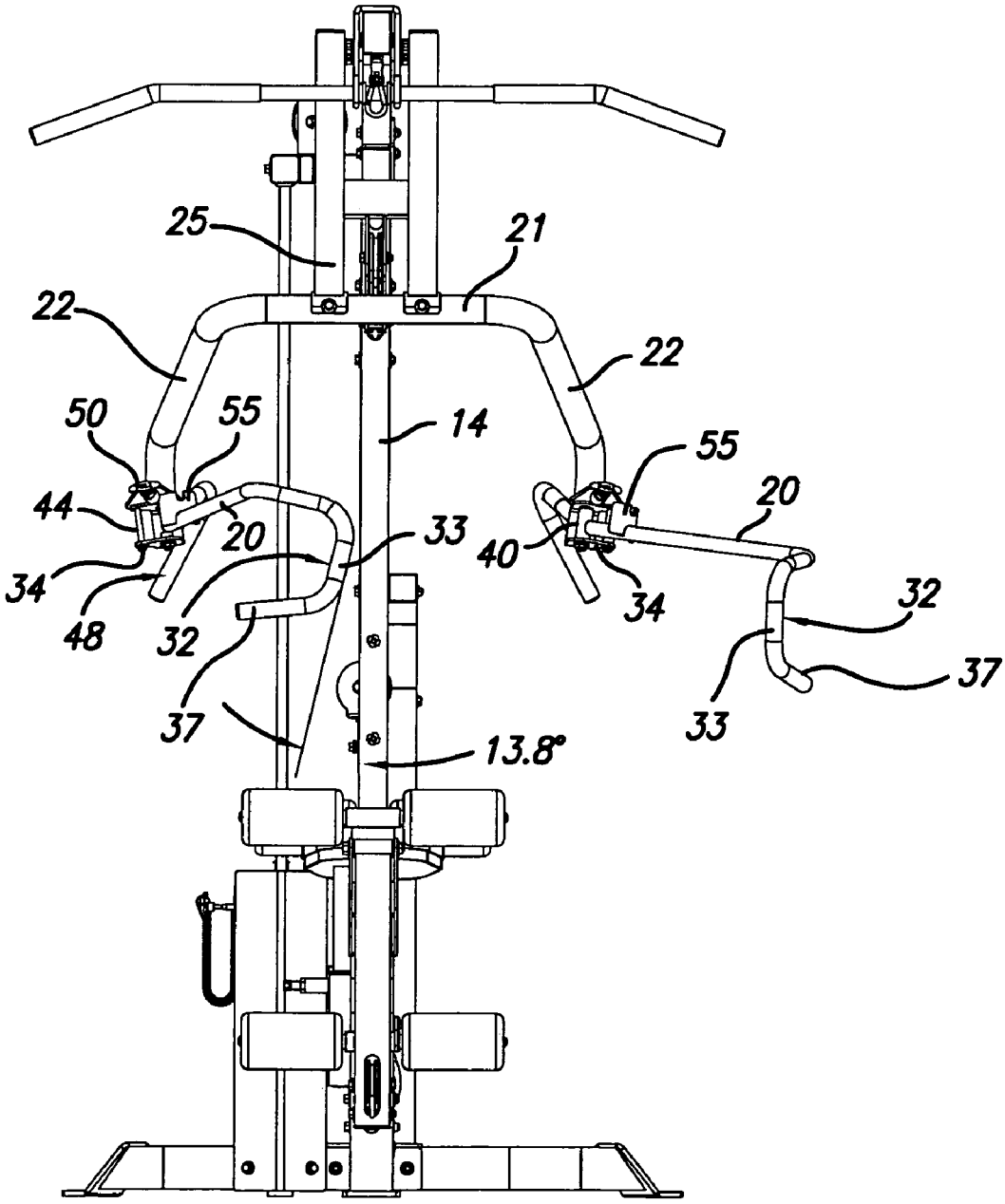
FIG. 12 is a front elevation view of the machine with the arms positioned as in FIG. 11.

The change in height of the handles during an exercise movement when the swing arms are free to rotate is illustrated in FIGS. 11 to 14. FIG. 11 illustrates the closest swing arm 20 in the inward position and the furthest swing arm 20 in the outward, rest position. FIG. 12 is a front view illustrating the same swing arm positions, with the left hand swing arm in the inward position and the right hand swing arm in the outward position. As illustrated in FIG. 11, there is an approximately 4⅝ inch rise in height as the swing arm is moved from the outward rest position (at the rear) to the inward position.

FIG. 11 also illustrates the distance a, b of the handle or grip 32 from the vertical upright in the outward and inward position, respectively. The distance a in an exemplary embodiment was around 4.45 inches, while distance b was around 6.22 inches. This represents the amount of "pre-stretch" the user would have in reaching for the handles. As the handles rotate inward, the pre-stretch decreases by approximately 1.75 inches.

FIG. 12 illustrates the angular rotation of the handle 32 when moving from the outer rest position (right hand side) and inner position (left hand side). When in the rest position, the first grip 33 is in a neutral or vertical orientation. When rotated to the inward position, the grip 33 goes through over 12 degrees of rotation. The second grip 37 also rotates as the handle rotates with the swing arm.

As can be seen in FIGS. 11 and 12, the compound angle of the swing arm pivot creates an increased handle elevation change during the exercise movement, which more closely duplicates the desired "chest to chin" movement performed with free weights. This motion also involves more of the chest muscles than a similar converging motion with little or no elevation change.

Figure 13:
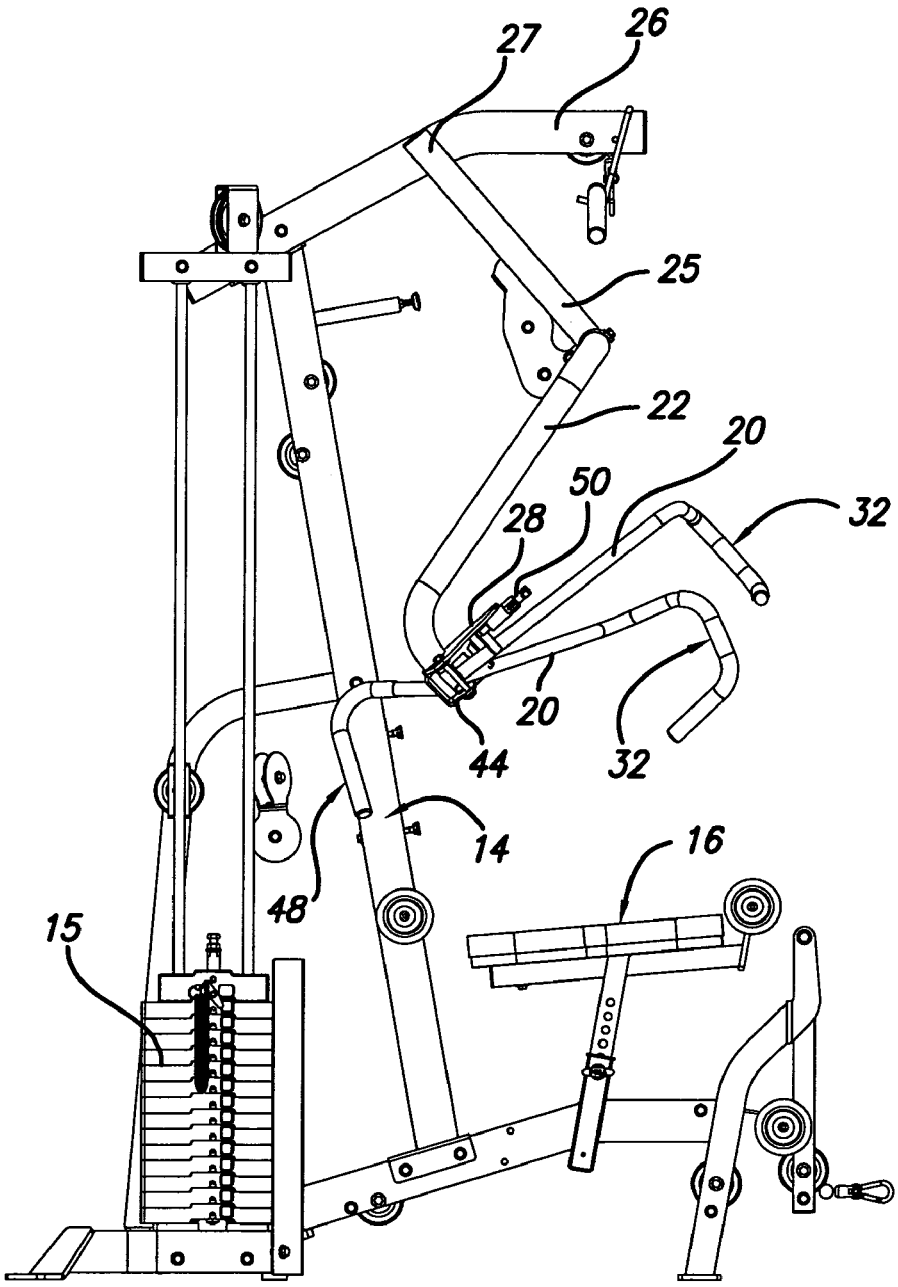
FIG. 13 is a side elevation view similar to FIG. 11, but with the main exercise arm rotated forward and the closest swing arm rotated inward, which is the finish position for both a converging press and a fly exercise.
Figure 14:
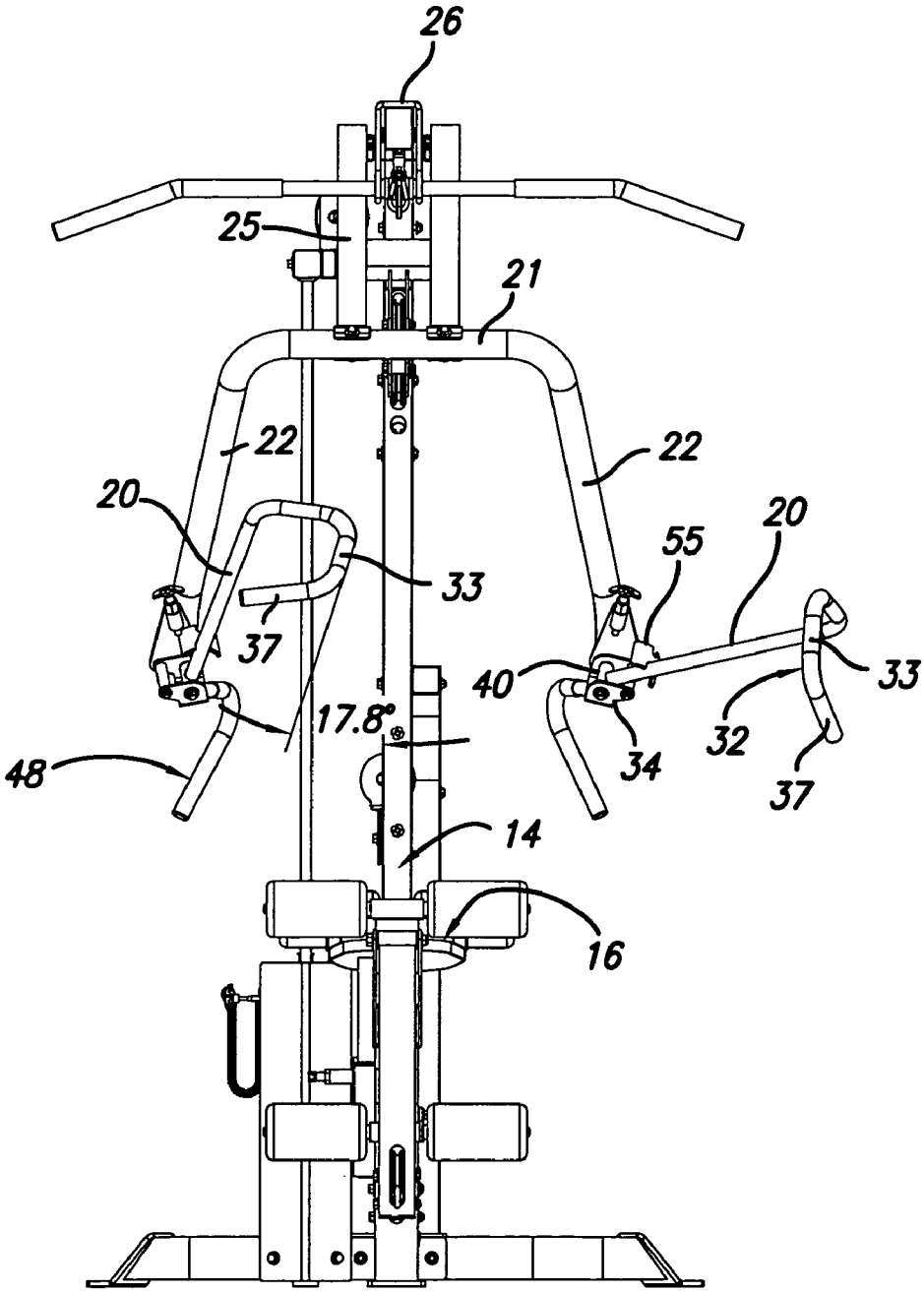
FIG. 14 is a front elevation view of the machine with the arms positioned as in FIG. 13.

FIGS. 13 and 14 are similar to FIGS. 11 and 12 but show the main arm 18 and one swing arm going through a converging (wide to narrow) press motion. FIG. 2 illustrates the start motion for this exercise. In FIG. 2, the main arm 18 is in the rest position and the swing arm 20 is rotated to a mid-position which is also the position for locking the swing arm. This represents the starting position for both the fixed and converging press exercise. In the fixed press exercise, the swing arm will be locked in this position using the pull pin 50. In the converging press exercise, the swing arm starts in the mid position but is not locked in this position, while the main arm is in a rest position. The main arm is then rotated forward and the swing arm rotated inward into the position illustrated for the forward swing arm in FIG. 13 and the left hand swing arm in FIG. 14. This represents the finish position for both a converging press and a fly exercise. The swing arm goes through approximately 5⁷⁄₁₆ inches of rise and over 6 degrees of grip rotation in performing the converging press exercise. The start position for a fly exercise will be the outward position, as illustrated for the rear arm in FIG. 11, and the finish position will be the position of the forward arm of FIG. 13. By comparing FIGS. 11 and 12 with FIGS. 13 and 14, it can be seen that the swing arm goes through over nine inches of rise and 16 degrees of grip rotation in performing a fly exercise.

As noted above, the swing arms 20 of the exercise arm assembly 12 can be locked in a fixed orientation relative to the main arm, using pull pins 50. The swing arms are shown in the locked position, which is approximately midway between the inward and outward position, in FIGS. 1, 8 and 10. This fixed position allows the user to perform a traditional "fixed" pressing movement similar to a barbell press. This exercise does not allow the user to control the inward/outward position of their hands and is easier for them to perform because they do not have to control the side-to-side movement of the swing arms.

Figure 9:
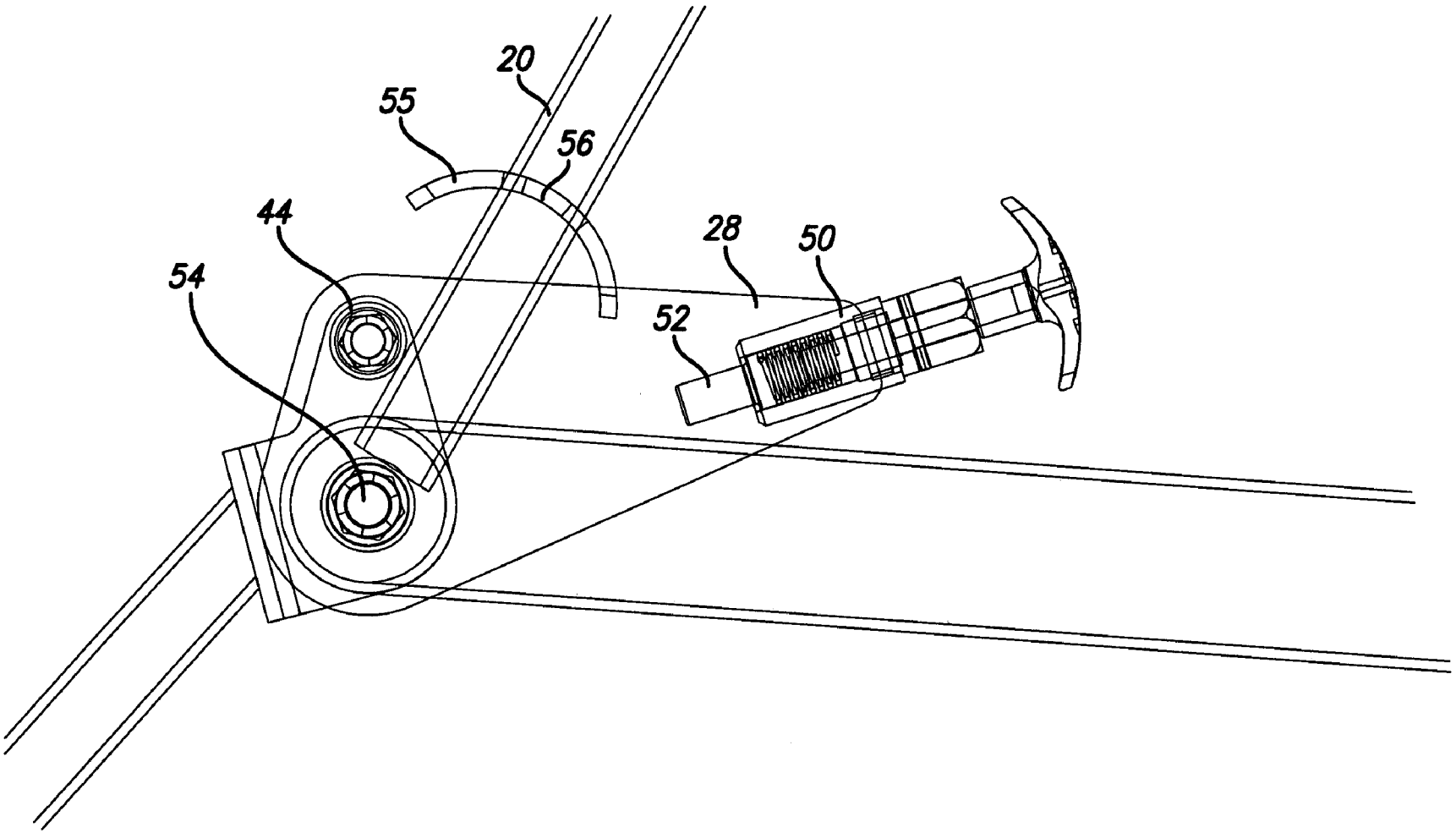
FIG. 9 is an enlarged top plan view of the swing arm pivot joint on one side of the arm assembly with the swing arm in the outward position and the pull pin in the engaged or extended position.
Figure 10:
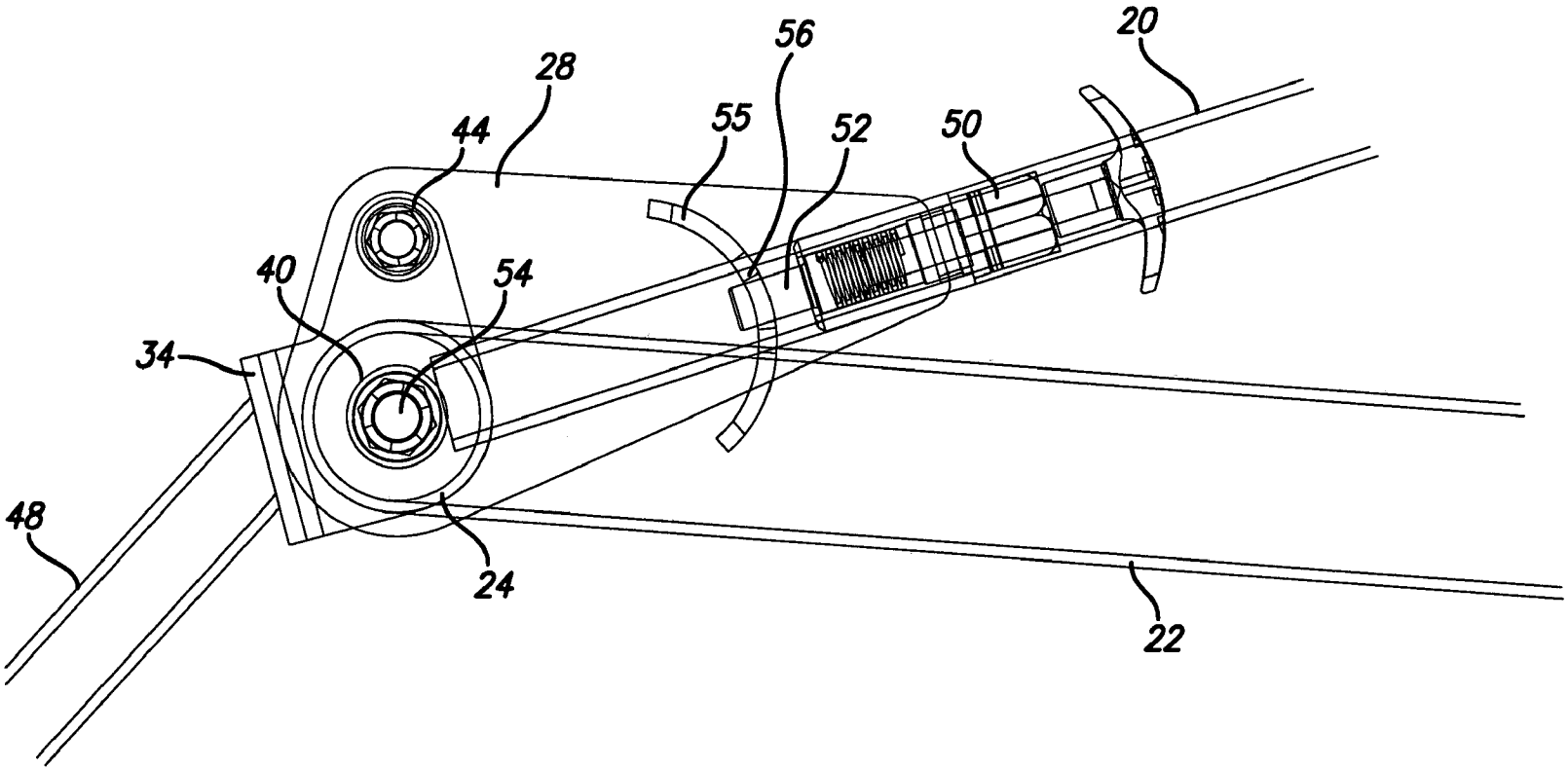
FIG. 10 is a view similar to FIG. 9 illustrating the swing arm in the locked position.

FIGS. 9 and 10 illustrate how the swing arm is moved into the locked position. FIG. 9 illustrates swing arm 20 in the outward position resting against stop pin 44. The pull pin is released to allow the spring loaded plunger 52 to be extended out of its housing. This puts the plunger 52 into the path of the receiving plate 55 as the swing arm is rotated towards the inward position (see also FIG. 4). As the swing arm 20 is moved inward, the receiving plate 55 will make contact with the plunger 52, depressing the plunger slightly inwardly as it continues to rotate over the outer face of the curved receiving plate. When the receiving slot 56 is aligned with plunger 52, the spring tension will automatically force the plunger into the slot and lock the spring arm in the fixed position, as indicated in FIG. 10. This arrangement allows the swing arm to be pivoted into position and automatically locked in place relative to the main arm, which will be much easier for the user. In order to release the swing arm, all that is necessary is for the pull pin to be locked in the open or disengaged position in which the plunger 52 is retracted into the pull pin housing. At this point, the swing arm will be free to rotate about its pivot.

The fixed handles 48 on the mounting bracket on each side of the arm assembly are in a fixed orientation relative to the main arm 18 and can be used to perform a mid row type of exercise, with the swing arms either in the outward, rest position or locked in the fixed position. The exercise arm assembly of FIGS. 1 to 14 has one main or primary pivot between the frame and the main arm, and a secondary pivot between each swing arm and the respective end of the main arm. The swing arm handles or grips 32 are fixed relative to the swing arms but are designed for optimum hand position during an exercise movement.

Figure 15:
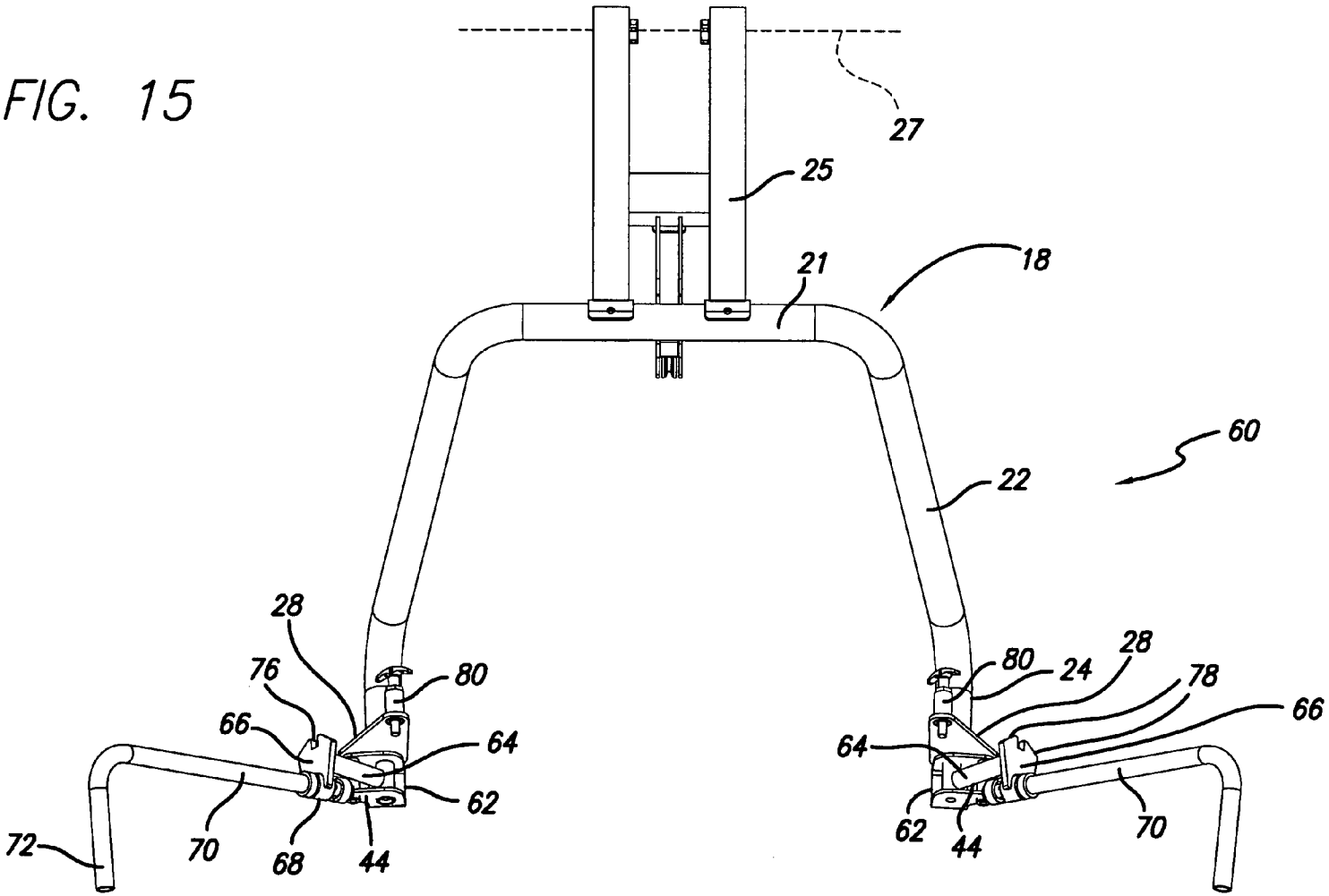
FIG. 15 is a front elevation view of an exercise arm assembly according to a second embodiment of the invention, with the swing arms in the outward, rest position.
Figure 16:
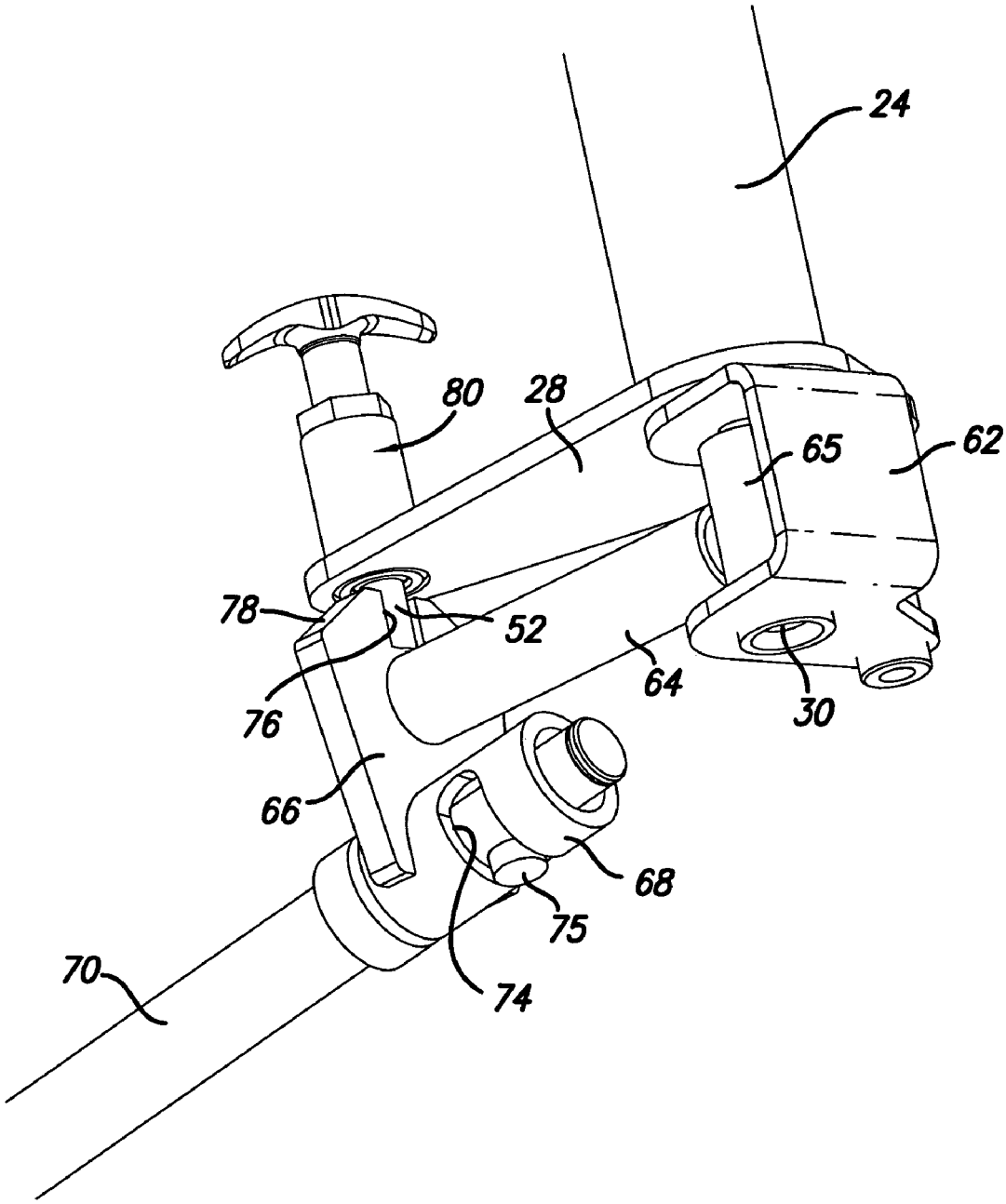
FIG. 16 is an exploded perspective view of the pivot joint on one side of the assembly of FIG. 15, illustrating the locked position of the swing arm.
Figure 17:
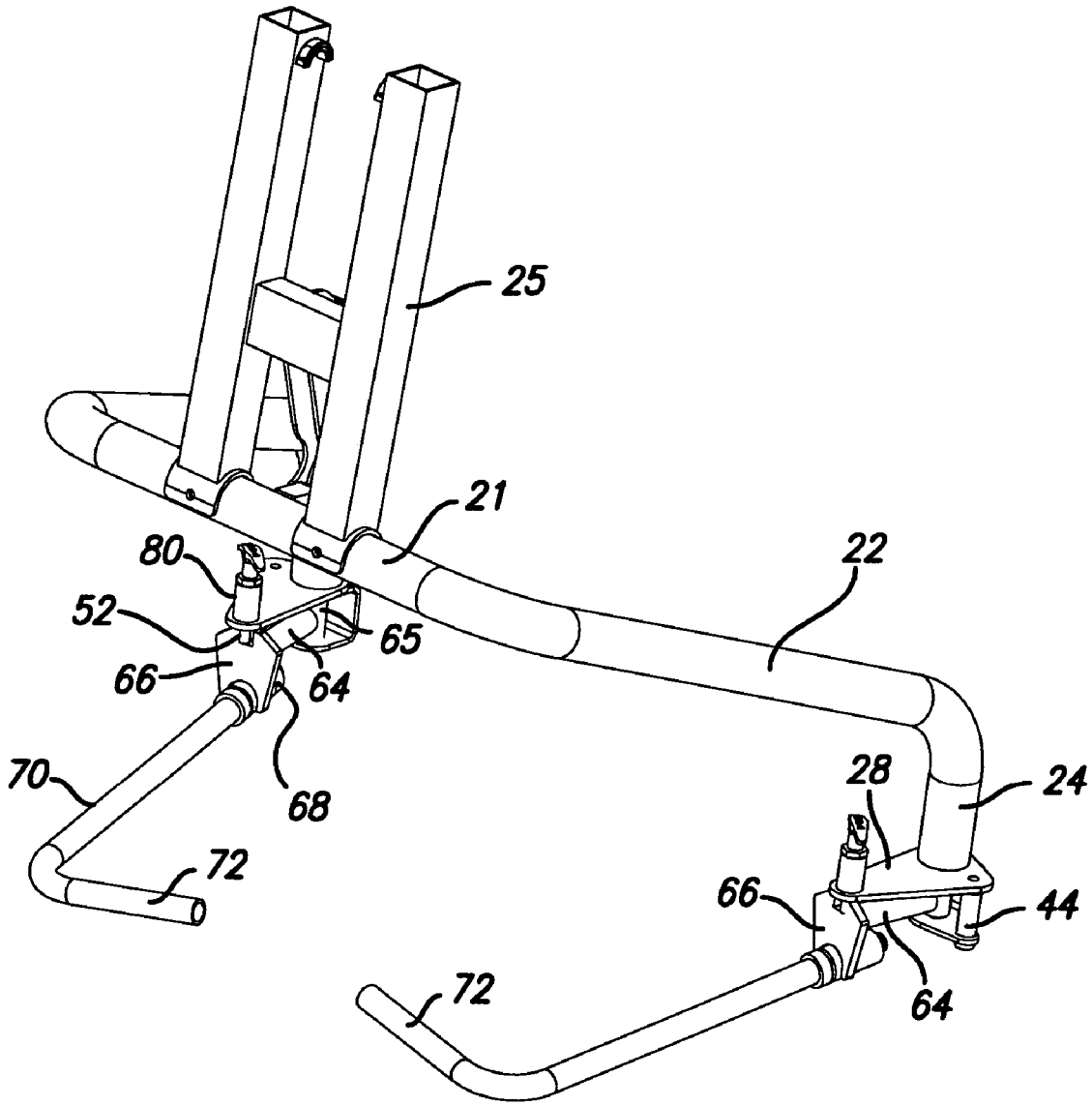
FIG. 17 is a perspective view of the exercise arm assembly of FIGS. 15 and 16 with the swing arms in the locked position.

FIGS. 15 to 17 illustrate an exercise arm assembly 60 according to a second embodiment of the present invention which may be installed on an exercise machine in the same way as the previous embodiment. The exercise arm assembly 60 is similar in some respects to the assembly 12 of FIGS. 1 to 14, and like reference numerals have been used for like parts as appropriate. However, this embodiment has a third pivot between the swing arm and handle to allow the handle or grip to rotate and provide different hand positioning for the user.

As in the previous embodiment, arm assembly 60 has a main arm 18 with a central portion 21, opposite side portions 22 which are bent downwardly, and inturned end portions 24. An end plate 28 is welded across each end of the main arm. The arm assembly can be mounted on an exercise machine in exactly the same way as the first embodiment, with the hanger bracket 25 pivoted to an upper strut of the machine for rotation about pivot axis 27.

As best illustrated in FIG. 16, a pivot mounting bracket 62 is secured to the end plate 28. A pivot pin 30 and a stop pin 44 are secured to the mounting bracket 62. A shorter, straight swing arm 64 is pivoted at one end over pivot pin 30 via sleeve 65, and has a receiving plate 66 secured across its opposite end. A receiving tube 68 is mounted at the lower end of receiving plate 66, and an elongated handle 70 is rotatably engaged at one end in the receiving tube 68. Handle 70 has a user engaging grip 72 at its opposite end. The receiving tube 68 has a slot 74 extending around part of its circumference. A pin 75 projects outwardly from the handle 70 to engage in slot 74 so as to limit the amount of rotation of the handle relative to the swing arm. Instead of multiple grip areas as in the previous embodiment, handle 70 has only one grip, 72, which can be rotated into a desired orientation.

The receiving plate 66 has a central slot 76 in its upper edge, and upwardly inclined ramp surfaces or edges 78 extend upwardly from the opposite sides of plate 66 up to the slot 76. The pull pin 80 in this embodiment is in a vertical rather than a horizontal orientation, and is mounted on top of end plate 28 so that the plunger 52 faces downwardly towards the receiving plate. The slanted or tapered top of the receiving plate 66 in this embodiment acts like the curved face of the first embodiment to automatically depress the pull pin plunger 52 as the handle and swing arm are rotated towards the central position, and to guide the plunger into the receiving slot 76. FIGS. 16 and 17 illustrate the plunger 52 engaged in the receiving slot. The swing arm and elongated handle are locked in a fixed position relative to the swing arm when the pull pin is engaged as in FIG. 16, although the hand grip orientation can be adjusted. In FIG. 17, the handles 70 are rotated so that the hand grips 72 are in a relatively horizontal orientation. This would be the starting position for performing a fixed motion press exercise.

FIG. 15 illustrates the swing arm and handle released and rotated into the outward, rest position against stop pin 44. As in the first embodiment, the pivot pins 30 on the ends of the main arm are inclined inwardly and forwardly, so that the swing arms will tend to rotate out into the rest position when released. In FIG. 15, the handles 70 are rotated so that the hand grips 72 are in a vertical or rest position. This would be the starting position for performing a fly exercise. The arm and handle motion in this embodiment is similar to the previous embodiment, with the swing arms and handles changing in elevation as they pivot between the outward and inward position, more closely duplicating the desired "chest to chin" movement of a free weight exercise. At the same time, the user can rotate the handle between the end positions defined by the ends of slot 74 so as to provide the most comfortable hand grip position.

Figure 18:
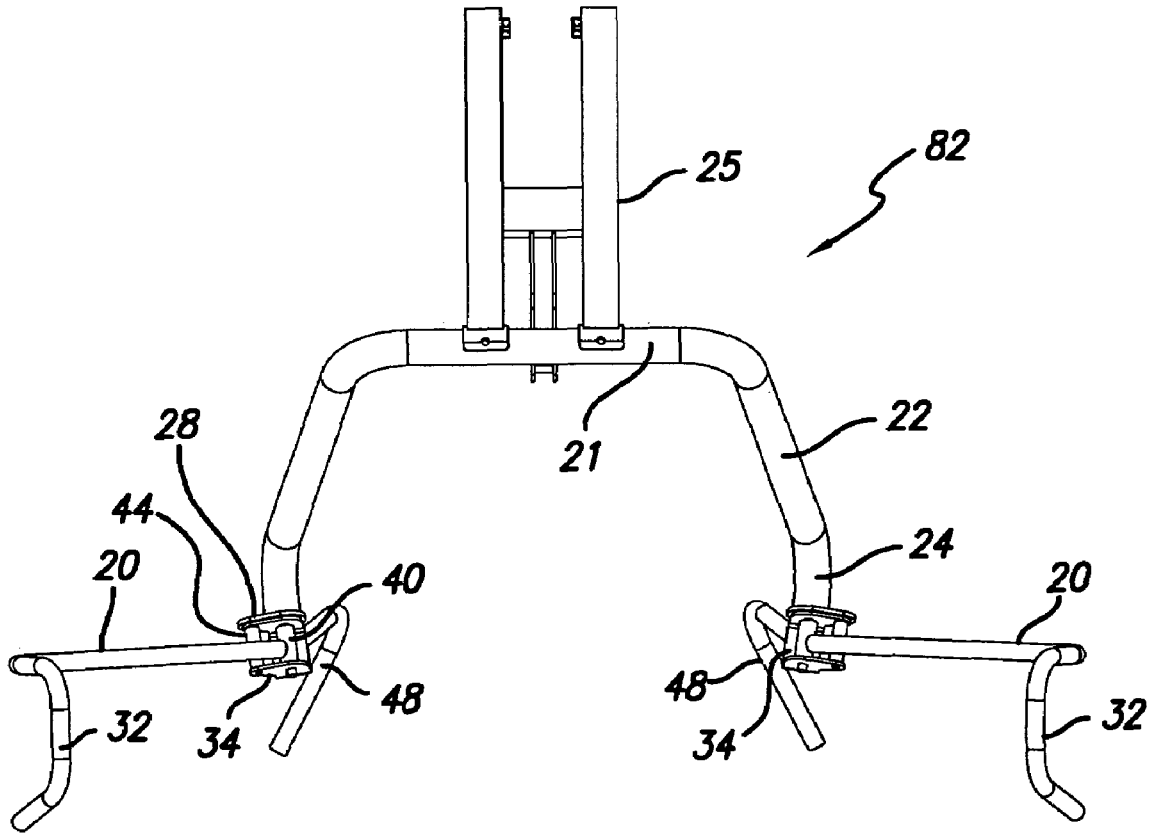
FIG. 18 is a front elevation view of an exercise arm assembly according to a third embodiment of the invention, with the swing arms in an outward position.
Figure 19:
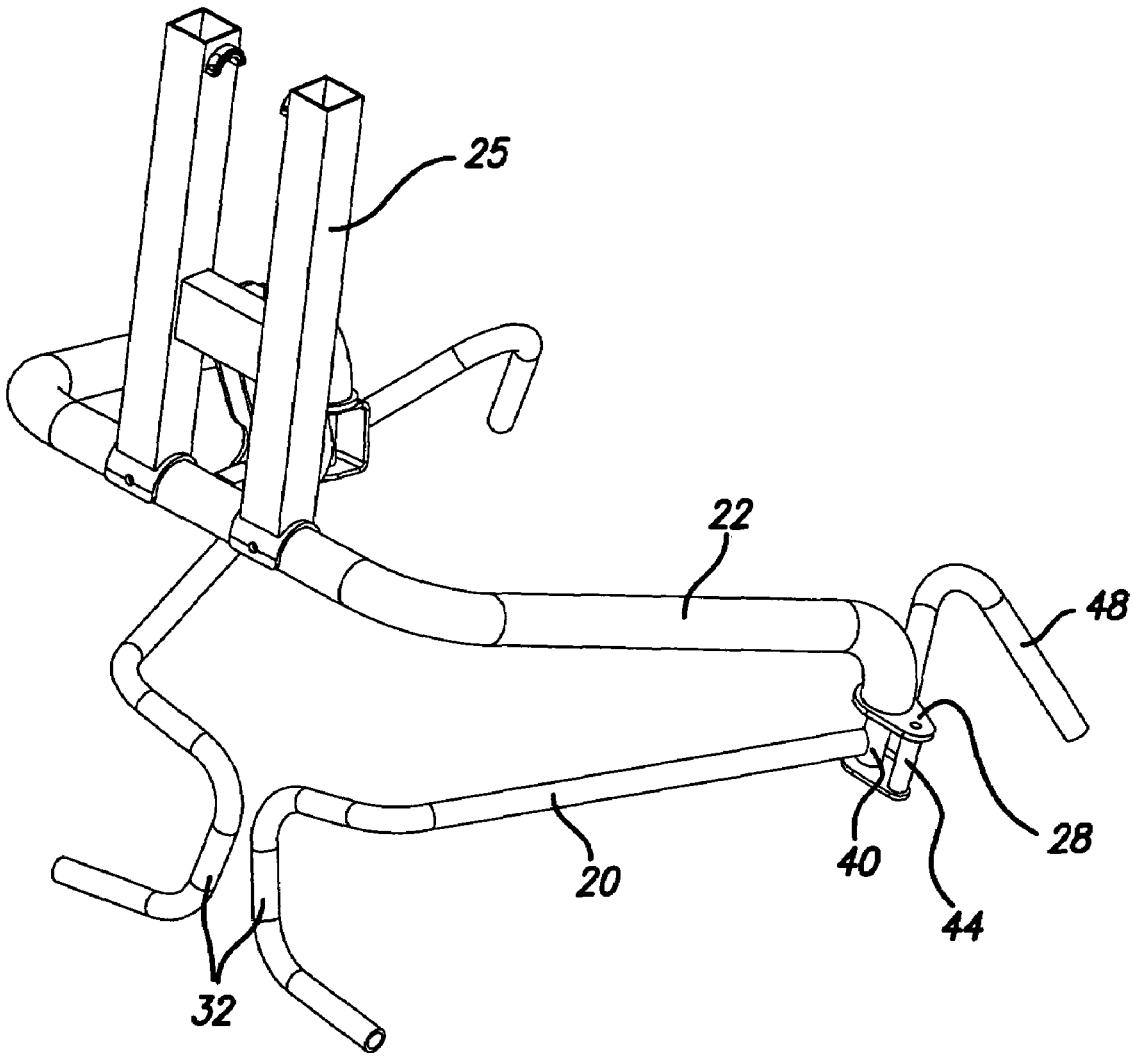
FIG. 19 is a front perspective view of the arm assembly of FIG. 18, with the swing arms in an inward position.
Figure 20:
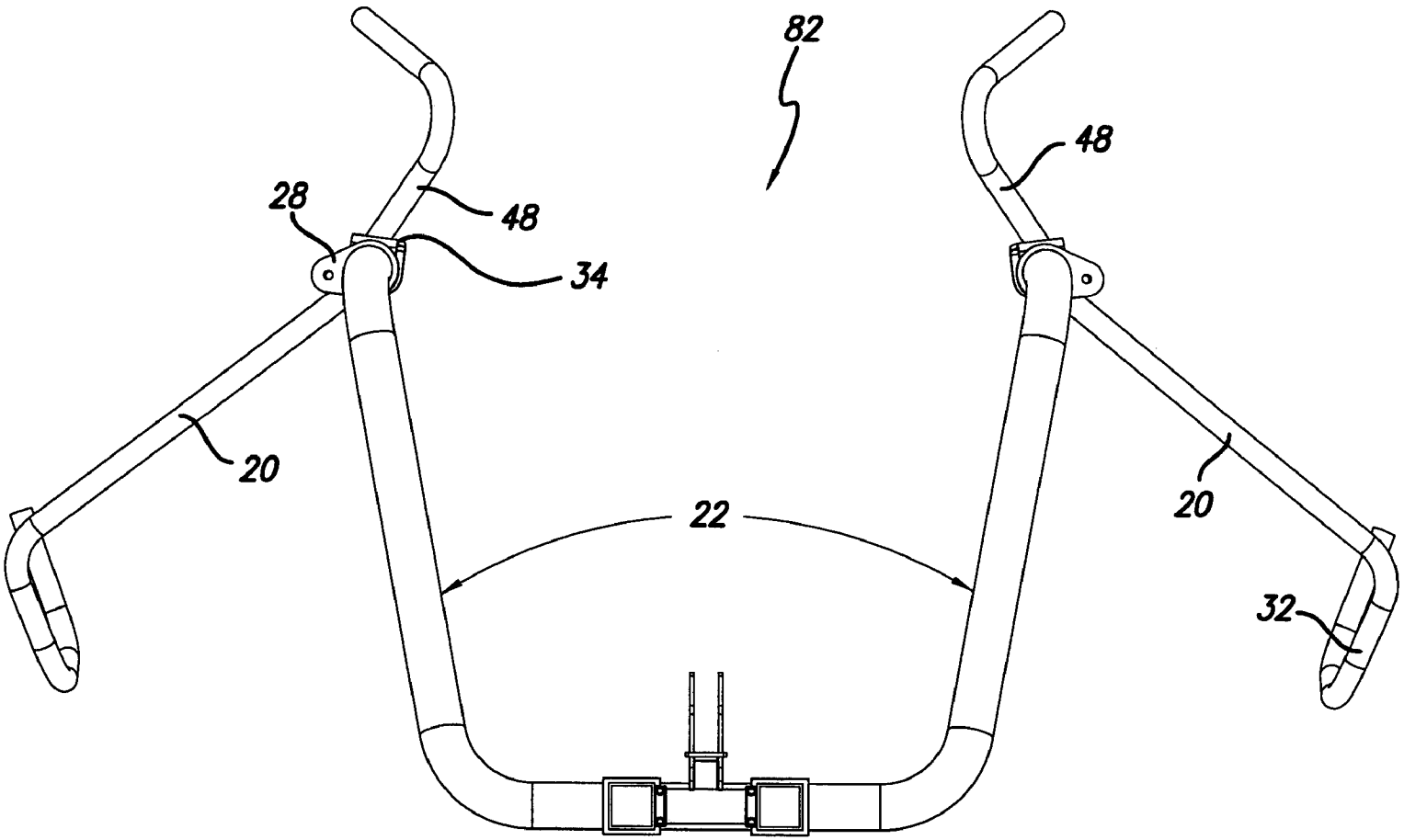
FIG. 20 is a top plan view of the arm assembly of FIG. 19, with the swing arms in the outward, rest position.

FIGS. 18 to 20 illustrate an exercise arm apparatus 82 according to a third embodiment of the invention, which is designed to be mounted on an exercise machine in the same way as the two previous embodiments. The exercise arm assembly is closest to the first embodiment, and like reference numerals have been used for like parts. The only difference between the exercise arm apparatus 82 and that of the first embodiment is that the receiving plate 55 and pull pin 50 have been eliminated, so that the swing arms 20 cannot be locked in position.

In the design of FIGS. 18 to 20, a user would not be able to perform a barbell-like fixed motion press exercise. However, this version is similar in all other respects to the embodiment of FIGS. 1 to 14. FIGS. 18 and 20 illustrate the swing arms 20 in the outward, rest position in which they are stopped against the stop pins 44. As in the first embodiment, the compound inward and forward angle of the swing arm pivots forces the arms to automatically fall into the outward rest position when released. FIG. 19 illustrates the arms in the inward position with the hand grips 32 close together, which would be the finish position for converging press and fly exercises.

Figure 21:
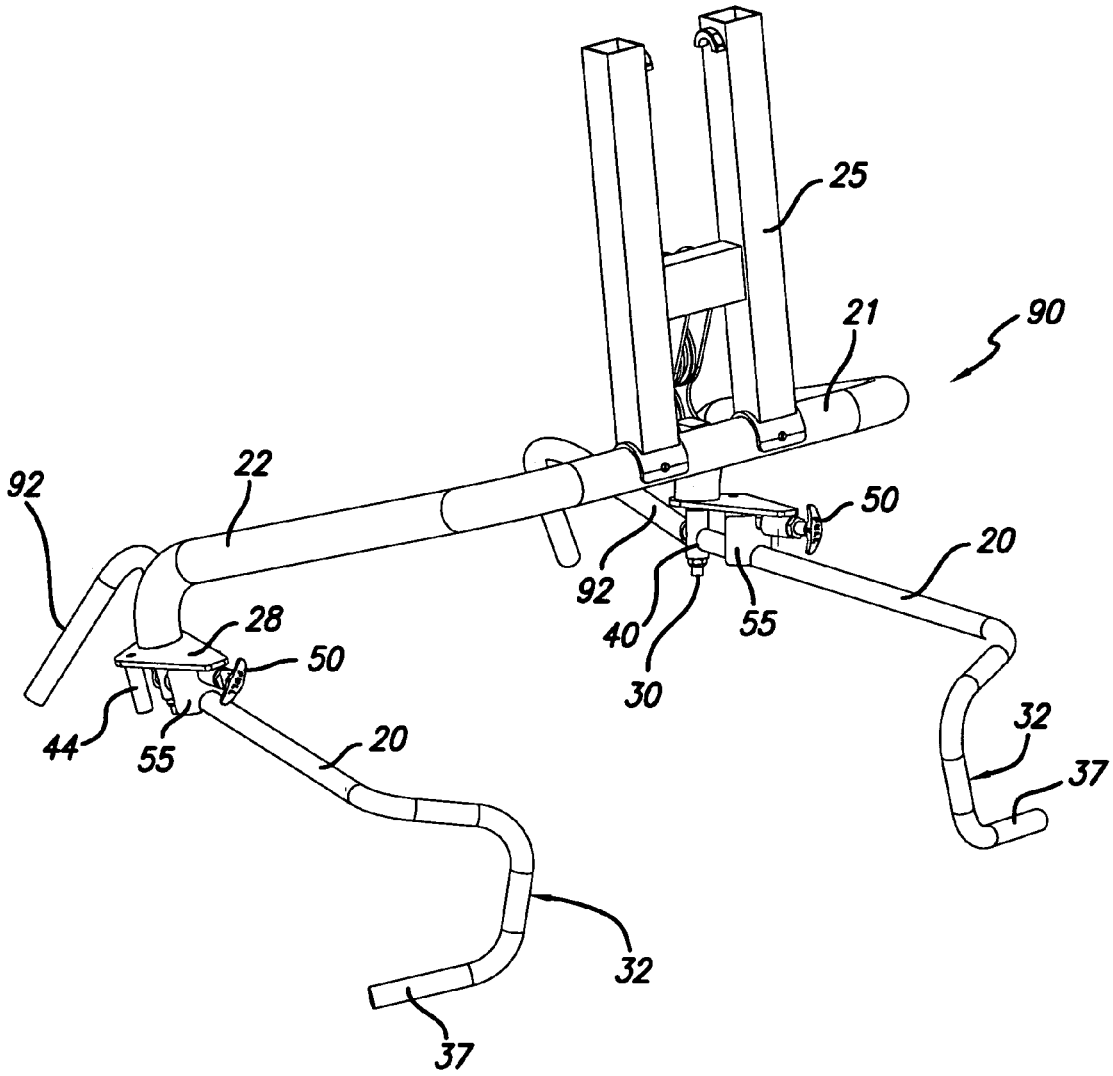
FIG. 21 is a front perspective view of an exercise arm assembly according to a fourth embodiment of the invention, with the swing arms in the locked position.
Figure 22:
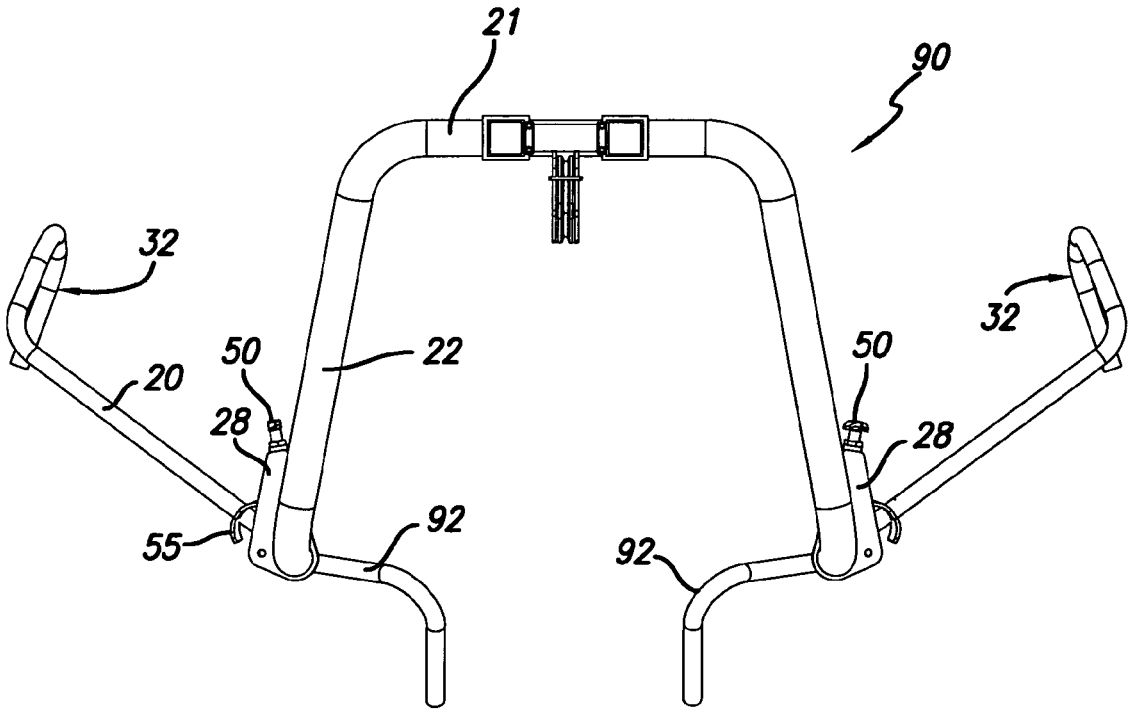
FIG. 22 is a top plan view of the arm assembly of FIG. 21, with the swing arms in the outward, rest position.
Figure 23:
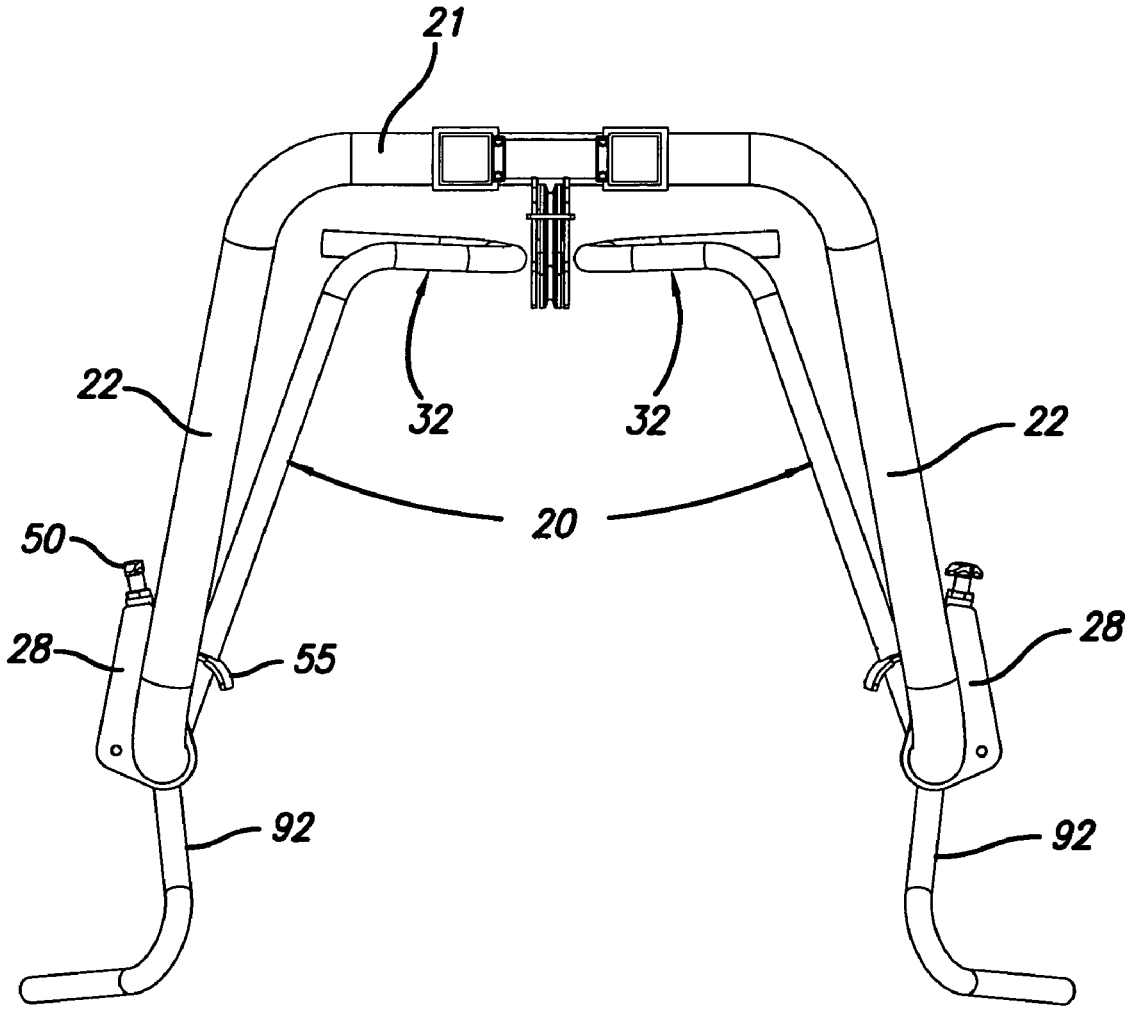
FIG. 23 is a top plan view of the arm assembly of FIG. 21, with the swing arms in an inner position.

FIGS. 21 to 23 illustrate an exercise arm assembly 90 according to a fourth embodiment of the invention. This embodiment is similar to the first embodiment, and like reference numerals have been used for like parts. However, unlike the first embodiment where the secondary handle 48 is attached to the pivot mounting bracket and fixed in orientation relative to the main arm, in this embodiment a secondary handle 92 is attached or associated with each swing arm 20.

As in the first embodiment, the exercise arm assembly 90 has a generally U-shaped main arm 18 which can be pivotally connected to an exercise machine via hanger brackets 25, and has downwardly depending arm portions 22 on each side with end portions 24 having end plates 28 secured across their free ends. Pivots 30 for the swing arms 20 project downwardly and inwardly from the plates 28, and define a compound secondary pivot axis as in the first embodiment. A sleeve 40 at the end of each swing arm 20 is pivotally engaged over each pivot 30. Also as in the first embodiment, a curved receiving plate 55 on the swing arm has a slot for receiving the plunger of pull pin 50 in the locked position illustrated in FIG. 21. In this embodiment, the mounting bracket 34 is eliminated and each secondary handle 92 is secured at one end to the pivoting sleeve 40 of the respective swing arm. This means that the secondary handles 92 will move inward and outward when the swing arms 20 are pivoted about their connection to the main arm.

In FIG. 22, the pull pins 50 have been released and the swing arms 20 are rotated outwardly to rest against the stop pins 44. At the same time, the secondary handles 92 will rotate inwardly. In FIG. 23, the swing arms 20 have been rotated inwardly to the inward position, simultaneously rotating the secondary handles 92 outwardly into the end position illustrated.

FIGS. 24 to 28 illustrate an exercise arm assembly 100 according to a fifth embodiment of the invention. In this embodiment, the swing arm cannot pivot freely about its connection to the main arm during the exercise, but instead is designed to be used in multiple fixed positions. The main arm 18 of this embodiment is similar to the first embodiment, and like reference numerals have been used as appropriate. As in the first embodiment, an end plate 102 welded to the end of each side of the main arm has a pivot pin 104 which projects downwardly from the end plate. A swing arm 105 is pivoted to the pivot pin 104 on each side of the exercise arm via pivot sleeve 106 welded to one end of the respective swing arm. The swing arms each have a handle or hand grip 108 at their opposite ends which is shaped for convenient gripping engagement by a user in a similar manner to handle 32 of the first embodiment. Alternatively, handles 105 may be pivotally mounted in a receiving tube, as in the second embodiment of FIGS. 15 to 17. As in the previous embodiment, a secondary handle 110 is secured to the opposite side of each pivot sleeve 106 from the swing arm, so as to rotate in position as the swing arm rotates about pivot pin 104.

In this embodiment, instead of a slotted receiving plate on the swing arm which defines one locked position of the swing arm, along with a stop pin to define an outward rest position, a single receiving plate 112 with multiple slots or openings 114 is secured to each swing arm for alignment with the plunger of a pull pin 115 secured in a generally vertical orientation at the end of plate 102. The separate stop pin is eliminated in this version of the exercise arm. Upwardly bent ends 116 of the receiving plate 112 act as stops to limit the inward and outward pivoting range of the swing arm when the pull pin is locked with the plunger in a retracted position.

The pivot pins 104 in this embodiment are inclined inwardly and forwardly in the same way as in the first embodiment. In the illustrated embodiment, the receiving plate 112 is provided with three spaced slots or openings 114 to define three different fixed positions of the swing arm. The swing arm can be rotated with the pull pin plunger in the retracted position. Once the desired position is reached, the plunger is released to extend through the selected opening 114. Because of the compound angle of the swing arm pivot axis, each time the swing arm is adjusted to a new position, the height and angle of the user engaging grips 108 will change, as will the height and angle of the grips on the secondary handles 110.

Figure 24:
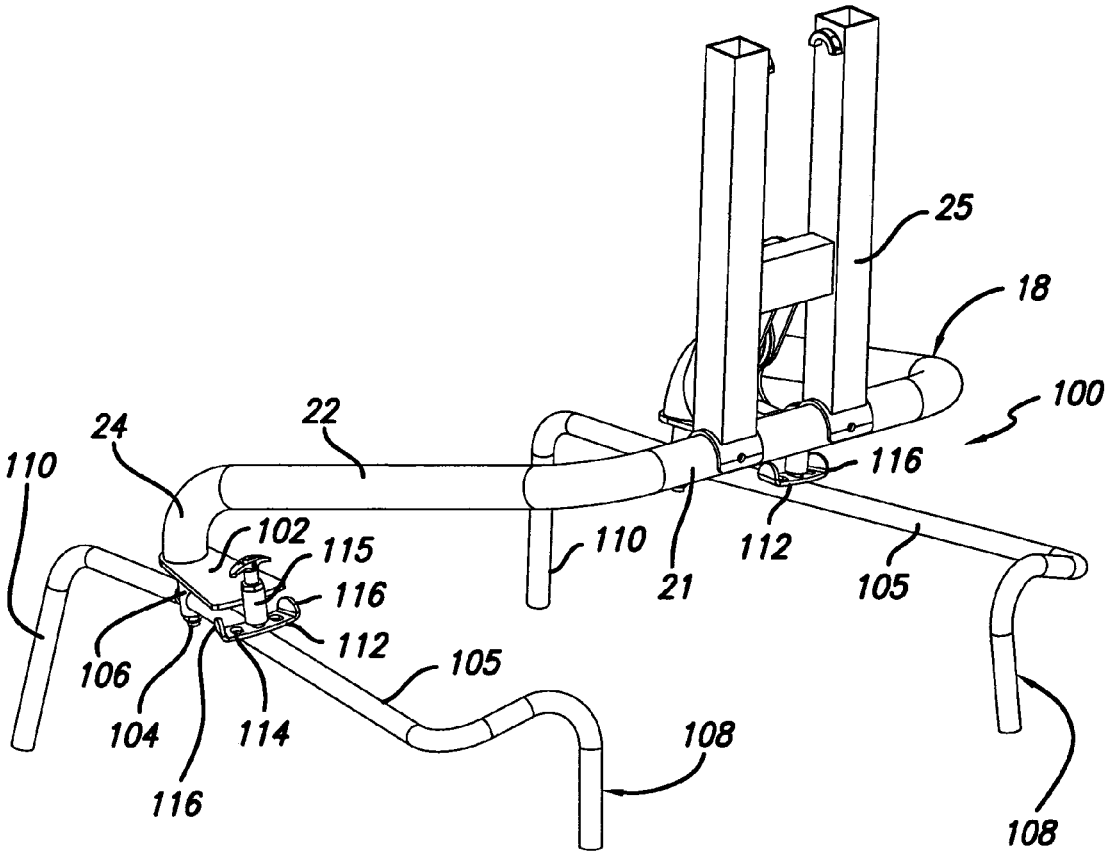
FIG. 24 is a front perspective view of an exercise arm assembly according to a fifth embodiment of the invention.
Figure 26:
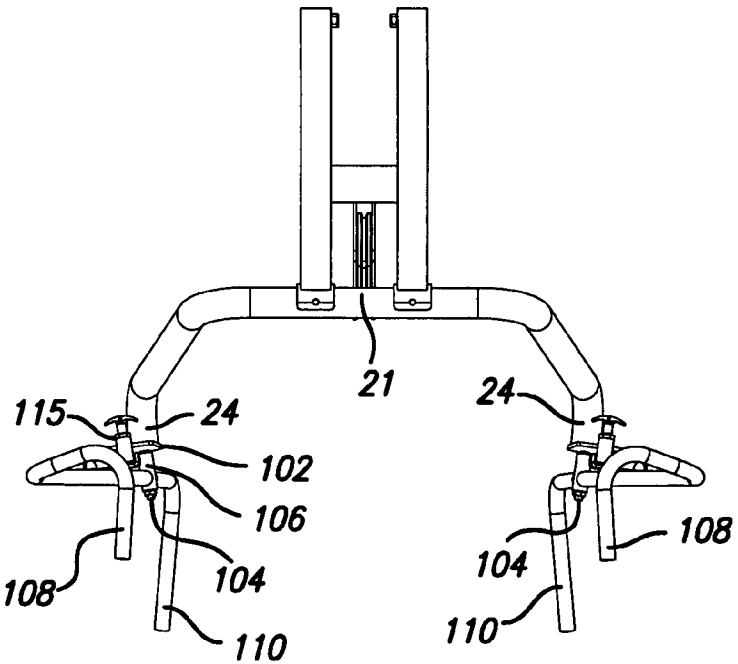
FIG. 26 is a front elevation view of the assembly of FIGS. 24 and 25, with the swing arms in the same position as in FIG. 25.
Figure 25:
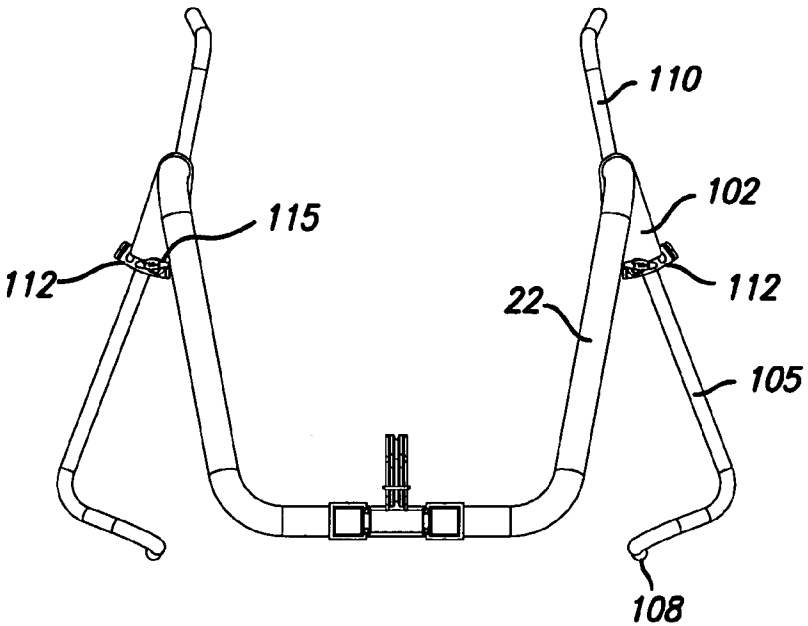
FIG. 25 is a top plan view of the assembly of FIG. 24, with the swing arms locked in an outward position.
Figure 28:
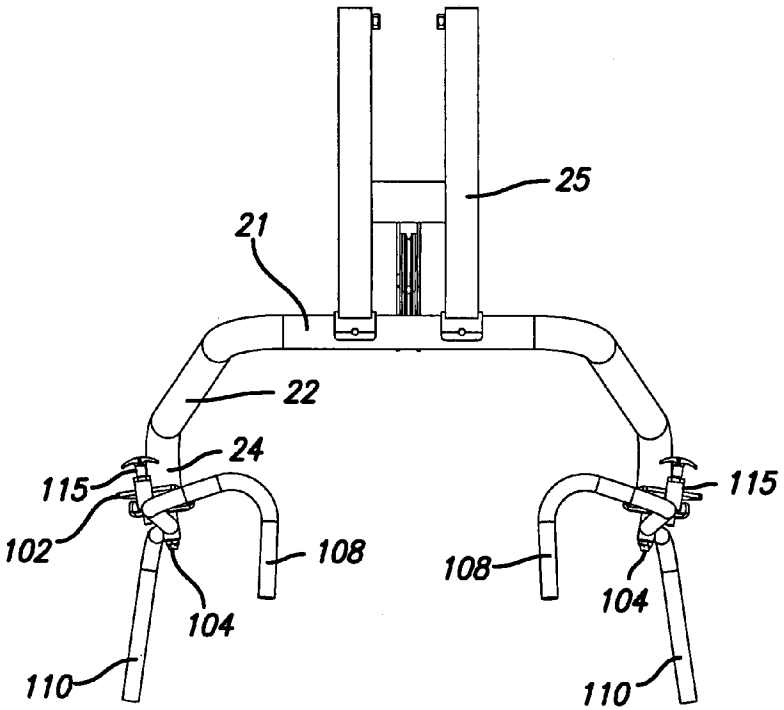
FIG. 28 is a front elevation view similar to FIG. 26, with the swing arms locked in the same position as in FIG. 27.
Figure 27:
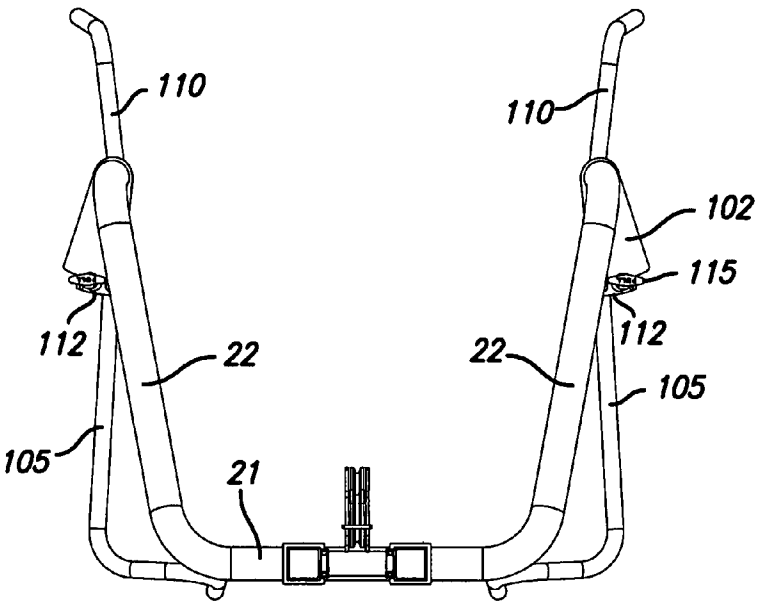
FIG. 27 is a top plan view similar to FIG. 25, with the swing arms locked in an inward position.

FIG. 24 illustrates the swing arm fixed in a central position with the pull pin 115 engaging the central opening 114 of the receiving plate 112. In FIGS. 25 and 26, the swing arms 105 are rotated outwardly so that the pull pin 115 is aligned and engaged with the innermost end opening 114. The height and angles of the user engaging grips 108, 110 when the swing arm is in this position can be seen in FIG. 26. In FIGS. 27 and 28, the swing arms 105 are rotated inwardly relative to the main arm so that the pull pin 115 is aligned and engaged with the outermost end opening 114 of the receiving plate. The height and angles of the user engaging grips 108, 110 in this position of the swing arm are illustrated in FIG. 28. It can be seen by comparing FIGS. 26 and 28 that the main hand grips 108 are rotated inward and the secondary handles are rotated outward and downward as the swing arm is rotated between the position of FIG. 25 and that of FIG. 27.

The compound pivot in this embodiment is designed to place the hand grips in the proper orientation for the exercise being performed. Each fixed position of the swing arm can be used to perform different exercises and/or to adjust the handle position for the size and shape of the user.

Figure 29:
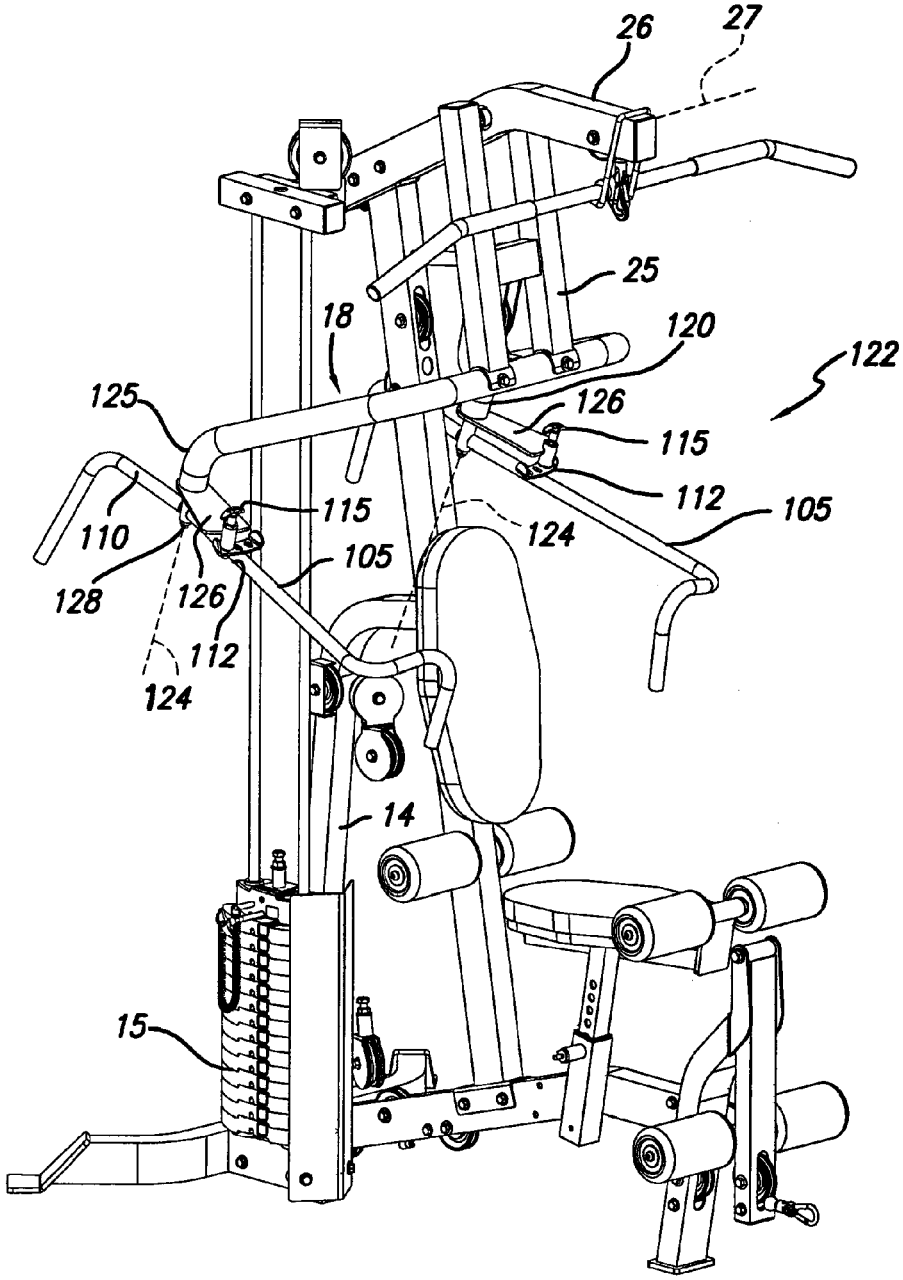
FIG. 29 is a front elevation view of an exercise machine with an exercise arm assembly according to another embodiment of the invention.
Figure 30:
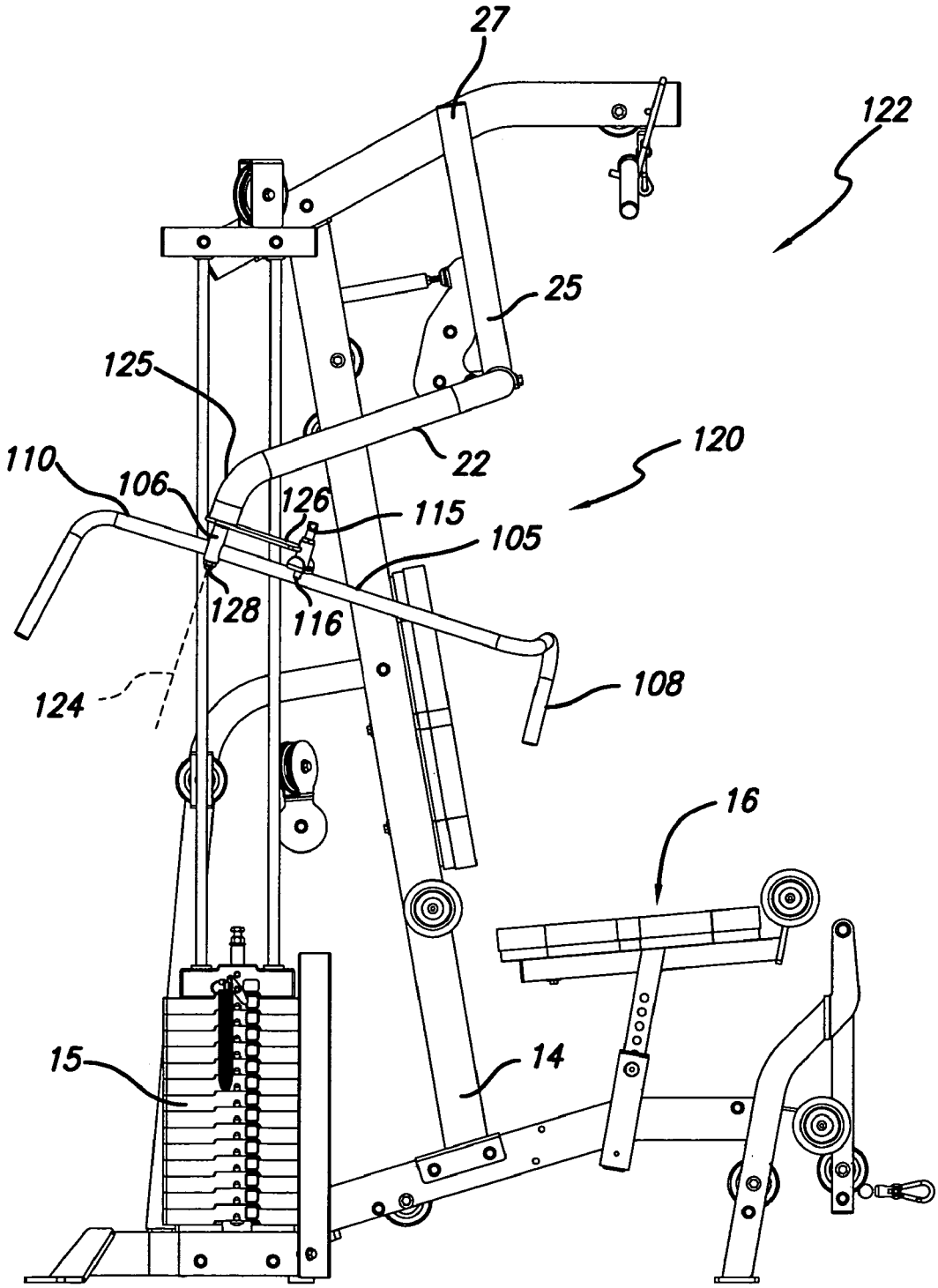
FIG. 30 is a side elevation view of the machine of FIG. 27.

FIGS. 29 and 30 illustrate an exercise arm assembly 120 according to another embodiment of the invention mounted on an exercise machine 122 in a similar manner to that described above in connection with FIGS. 1 and 2. The main arm 18 and swing arms 105 of the exercise arm assembly 120 of FIGS. 29 and 30 are similar to that of the embodiment of FIGS. 24 to 28, and like reference numerals are used for like parts as appropriate. The main difference between this embodiment and the previous embodiments is the secondary or swing arm pivot axis 124. In this version, unlike the previous embodiments, the swing arm pivot axes 124 are parallel to one another (see FIG. 29) and they angle rearward rather than forward.

The main arm in this embodiment is similar to the previous embodiments, except that the end portion 125 is inclined rearwardly, so that the end plates 126 are inclined downwardly, and the pivot pins 128 are also inclined rearwardly and parallel to one another to define the swing arm pivot axes. When the pivot sleeve 106 on each swing arm 105 is engaged over the respective pivot pin 128, the swing arms 105 will be angled downwardly and the secondary handles 110 angle upwardly, as best seen in FIG. 30. Although this version may be desirable in some cases, it lacks some of the benefits of the previous embodiments. First, there is no perceivable change in the height of the multi-position grip 108 when the swing arms are rotated outward. There is also no perceivable angular (pronation) change in the grip 108 as it adjusts from one fixed position to the next. There is also less elevational change to the handles during the exercise movement.

In each of the illustrated embodiments, the two swing arms are pivoted to the frame via the main arm for pivoting about the same primary pivot axis, for dependent movement. However, in alternative embodiments, the main arm may be split into two separate main arms which are separately pivoted to the frame for independent movement. The exercise arm apparatus of any of the above embodiments may be mounted on the frame of an exercise machine in any suitable manner, either suspended from an overhead strut as illustrated in FIGS. 1 and 2, or secured to an upright strut.

The exercise arm assembly of this invention transforms traditional, fixed arc, linear exercise movement patterns into user-defined, multiple converging/diverging exercise movement patterns. The swiveling user engaging swing arms or handles of the exercise arm assemblies described above are designed to provide a converging or wide to narrow movement pattern, allowing the user to perform a dumbbell like exercise. By pivotally attaching the swing arms and handles to the main arm, this design provides a user-defined motion which allows the exerciser to direct their hands in the desired exercise path. The swing arms in some embodiments can be locked in place in one or more different positions, to provide the option of a more traditional fixed motion or barbell-like exercise. The multi-position hand grips at the ends of the swing arms or the rotating hand grips of FIGS. 15 to 17 provide proper hand positioning for both press and fly exercises, and allow the user to replicate the movement of the equivalent dumbbell exercises.

One key feature of most of the embodiments described above is the compound angle of the secondary or swing arm pivot. The swing arm pivots in all except the last embodiment are angled inwardly towards one another to intersect at a location spaced below the main arm pivot. These pivots are also angled forwardly relative to the vertical or gravitational axis of the exercise assembly, when the main arm is in the rest position. The compound angle of the swing arm pivots forces the arms to automatically fall outward into the rest position when released. This allows users to enter and exit the machine easily, and also keeps the swing arms out of the way when other exercises not involving the swing arms are carried out.

Another advantage of the compound swing arm pivot angle is that it forces the swing arms to change in elevation as they are pivoted inwardly and outwardly, creating a greater handle elevation change during the exercise movement. This more closely duplicates the desired chest to chin movement performed with free weights and involves more of the chest muscles than prior art pressing arms without such a compound pivot axis angle. It also moves the multi-position grip on each swing arm into the proper starting height for both press and fly exercises, and forces the user's hands to pronate during the exercise movement. This motion, together with the converging motion, increases chest muscle involvement.

Although some preferred embodiments of the invention have been described above by way of example only, it will be understood by those skilled in the field that modifications may be made to the disclosed embodiments without departing from the scope of the invention, which is defined by the appended claims.

I claim:

1. An exercise arm assembly, comprising:

a main arm having a central region and opposite ends, the central region having a first pivot connection for connection to a frame of an exercise machine to allow pivoting of the main arm about a first pivot axis;

a first swing arm pivoted to one end of the main arm for pivoting about a first swing arm pivot axis;

a second swing arm pivoted to the opposite end of the main arm for pivoting about a second swing arm pivot axis;

each swing arm having at least one handle spaced from the respective swing arm pivot axis for gripping by a user when performing exercises;

the swing arm pivot axes being inclined inwardly towards one another to intersect at a location spaced below the first pivot axis; and a pivot connection between the main arm and each swing arm defining said first and second swing arm pivot axes, each pivot connection including an end stop defining an outward rest position for the respective swing arm, each swing arm pivot axis being at a predetermined angle such that the respective swing arm will automatically fall outward into the rest position when released.

2. An exercise arm assembly, comprising:

a main arm having a central region and opposite end portions, the central region having a first pivot connection for connection to a frame of an exercise machine to allow pivoting of the main arm about a first pivot axis;

a first swing arm pivotally associated with a first end portion of the main arm for pivoting about a first swing arm pivot axis;

a second swing arm pivotally associated with a second end portion of the main arm for pivoting about a second swing arm pivot axis;

each swing arm having at least one handle spaced from the respective swing arm pivot axis for gripping by a user when performing exercises;

the swing arm pivot axes being inclined inwardly towards one another to intersect at a location spaced below the first pivot axis; and each swing arm pivot axis is at a predetermined compound angle which is inclined inwardly towards the other swing arm pivot axis and forwardly towards the handle, whereby the handle changes in elevation as the swing arm is pivoted between an outward rest position and an inward position.

3. The apparatus as claimed in claim 2, further comprising a pivot connection pivotally connecting each handle to the respective swing arm for rotation about a handle pivot axis spaced from the swing arm pivot axis.

4. The apparatus as claimed in claim 3, wherein the pivot connection comprises a receiving tube, the handle having an end portion rotatably mounted in said receiving tube.

5. The apparatus as claimed in claim 4, wherein the pivot connection further comprises a range limiting device for limiting rotation of the handle about the handle pivot axis.

6. The apparatus as claimed in claim 2, further comprising a secondary handle secured to each end of the main arm for use in performing additional exercises.

7. The apparatus as claimed in claim 2, wherein the swing arm pivot axis is inclined inwardly at a predetermined angle which is approximately 8 degrees to the vertical when the apparatus is installed on an exercise machine.

8. An exercise arm assembly, comprising:

a main arm baying a central region and opposite end portions, the central region having a first pivot connection for connection to a frame of an exercise machine to allow pivoting of the main arm about a first pivot axis;

a first swing arm pivotally associated with a first end portion of the main arm for pivoting about a first swing arm pivot axis;

a second swing arm pivotally associated with a second end portion of the main arm for pivoting about a second swing arm pivot axis;

each swing arm having at least one handle spaced from the respective swing arm pivot axis for gripping by a user when performing exercises;

the swing arm pivot axes being inclined inwardly towards one another to intersect at a location spaced below the first pivot axis; and the swing arm has a generally straight portion extending from the swing arm pivot up to a bend, and the handle comprises an integral bent end portion of the swing arm extending from said bend;

the bent end portion comprising a first portion extending inwardly from said bend towards the handle on the opposite arm, and a second portion projecting generally downwardly from said first portion.

9. The apparatus as claimed in claim 8, wherein the handle further comprises a third portion bent outwardly from said second portion, the second and third portions comprising grips for selective gripping by a user with their hands in different orientations.

10. An exercise arm assembly, comprising:

a main arm having a central region and opposite end portions, the central region having a first pivot connection for connection to a frame of an exercise machine to allow pivoting of the main arm about a first pivot axis;

a first swing arm pivotally associated with a first end portion of the main arm for pivoting about a first swing arm pivot axis;

a second swing arm pivotally associated with a second end portion of the main arm for pivoting about a second swing arm pivot axis;

each swing arm having at least one handle spaced from the respective swing arm pivot axis for gripping by a user when performing exercises;

the swing arm pivot axes being inclined inwardly towards one another to intersect at a location spaced below the first pivot axis;

a secondary handle secured to each end portion of the main arm for use in performing additional exercises; and a pivot mounting bracket secured to each end of the main arm, the pivot mounting bracket having a pivot connection pivotally connecting the swing arm to the bracket for pivoting about the respective swing arm pivot axis, and the secondary handle being secured to the bracket to project in a direction generally away from the swing arm.

11. An exercise machine, comprising:

a support frame having a base, an upright portion extending upwardly from the base and having an upper end, and an upper support extending transversely from the upper end of the upright portion;

a seat supported on the frame facing a forward end of the machine;

an exercise arm apparatus pivotally secured to the frame, the apparatus comprising a main arm pivotally secured to the frame for rotation about a primary pivot axis, a first swing arm extending on one side of the seat and pivotally secured to the main arm for rotation about a swing arm pivot axis between outward and inward positions, and at least one handle associated with the swing arm, a second swing arm pivoted to the main arm on the opposite side of the seat to the first swing arm for pivoting about a second swing arm pivot axis, the swing arm pivot axes being parallel to one another and at a predetermined orientation relative to the main arm pivot axis such that the swing arm pivot axes are inclined rearward when the main arm is in a rest position; and first and second locking members on the main arm and at least the first swing arm, respectively, one of said locking members having a plurality of slots for selective engagement with the other locking member to define a plurality of different fixed positions for said first swing arm.

12. The machine as claimed in claim 11, further comprising an end plate on the main arm, a pivot member extending from said end plate in a direction away from the main arm to define said first swing arm pivot axis, the first swing arm pivotally engaging said pivot member, the second locking member comprising a receiving plate on the first swing arm at a location spaced from said first swing arm pivot axis, the receiving plate having said plurality of slots defining plural fixed positions of said first swing arm about said pivot axis, and the first locking member being mounted on said main arm end plate for releasable engagement in a selected slot.

13. The machine as claimed in claim 11, further comprising a secondary handle associated with each swing arm for pivotal motion with the respective swing arm.

14. An exercise machine, comprising:

a support frame having a base, an upright portion extending upwardly from the base and having an upper end, and an upper support extending transversely from the upper end of the upright portion;

a seat supported on the frame facing a forward end of the machine;

an exercise arm apparatus pivotally secured to the frame, the apparatus comprising a main arm having opposite ends, the main arm being pivotally secured to the frame for rotation about a primary pivot axis, a first swing arm pivotally secured to one end of the main arm for rotation about a first swing arm pivot axis between outward and inward positions, and a second swing arm pivotally secured to the opposite end of the main arm for rotation about a second swing arm pivot axis between outward and inward positions, the swing arms extending on opposite sides of said seat;

the swing arm pivot axes being inclined inwardly towards one another and non-perpendicular to the main pivot axis; and a handle associated with each swing arm;

whereby each handle changes in elevation as the respective swing arm is pivoted back and forth between the outward and inward positions, each handle being at a higher elevation in the inward position than in the outward position of the respective swing arm.

15. The machine as claimed in claim 14, further comprising a pivot connection device between each swing arm and the respective end of the main arm, the pivot connection device further comprising an end stop for defining an outward rest position for the respective swing arm, and the swing arm pivot axes being oriented such that the swing arms automatically fall outwardly into said rest position when released.

16. The machine according to claim 15, wherein the swing arm pivot axes are also inclined forwardly relative to the vertical direction, each swing arm pivot axis having a compound inward and forward pivot angle.

17. The machine according to claim 14, wherein each main arm has a central portion pivoted to the machine frame and opposite side portions, each side portion having a first downward bend separating the side portion into a first portion extending from the primary pivot axis to the first bend, a second portion inclined downwardly from the first portion, and an end portion bent inwardly and downwardly relative to the second portion and aligned with said swing arm pivot axis.

18. The machine as claimed in claim 14, including a pivot connection between the main arm and each swing arm defining said swing arm pivot axis, said pivot connection including a range of motion device having a series of spaced holes extending along an arc, and a connecting pin associated with each end of the main arm for releasably connecting said main arm to said range of motion device at any one of a series of selected orientations relative to said range of motion device.

19. An exercise machine, comprising:

a support frame having a base, an upright portion extending upwardly from the base and having an upper end, and an upper support extending transversely from the upper end of the upright portion; a seat supported on the frame facing a forward end of the machine;

an exercise arm apparatus pivotally secured to the frame, the apparatus comprising a main arm pivotally secured to the frame for rotation about a primary pivot axis, at least one swing arm extending on one side of the seat and pivotally secured to the main arm for rotation about a swing arm pivot axis between outward and inward positions, and at least one handle associated with the swing arm; and the swing arm pivot axis being inclined inwardly towards the seat and non-perpendicular to the main pivot axis.

20. An exercise machine, comprising:

a support frame having a base, an upright portion extending upwardly from the base and having an upper end, and an upper support extending transversely from the upper end of the upright portion, the support frame having a vertical axis;

a seat supported on the frame facing a forward end of the machine;

an exercise arm apparatus pivotally secured to the frame, the apparatus comprising at least one main arm pivotally secured to the frame for rotation about a primary pivot axis, at least one swing arm extending on one side of the seat and pivotally secured to the main arm for rotation about a swing arm pivot axis between outward and inward positions, and at least one handle associated with the swing arm;

the swing arm pivot axis having a downward angle of inclination relative to the vertical axis and being directed downward towards the forward end of the machine when the main arm is in a rest position.

21. The apparatus as claimed in claim 20, wherein each swing arm pivot axis is inclined forwardly at a predetermined angle which is approximately 13 to 14 degrees from the vertical when the apparatus is installed on an exercise machine.

22. An exercise machine, comprising:

a support frame having a base, an upright portion extending upwardly from the base and having an upper end, and an upper support extending transversely from the upper end of the upright portion;

a seat supported on the frame facing a forward end of the machine;

an exercise arm apparatus pivotally secured to the frame, the apparatus comprising a main arm pivotally secured to the frame for rotation about a primary pivot axis, at least one swing arm extending on one side of the seat and pivotally secured to the main arm for rotation about a swing arm pivot axis between outward and inward positions, and at least one handle associated with the swing arm;

a first locking member on the main arm and a second locking member on the swing arm for releasable locking engagement with the first locking member to secure the swing arm in at least one fixed position relative to the main arm;

one of said locking members comprising a receiving device having at least one slot defining the fixed position of said swing arm and the other locking member comprising a spring-loaded device biased between an extended position for engagement in said slot and a retracted position to allow free rotation of said swing arm; and the receiving device having first and second inclined ramp surfaces extending in opposite directions up to said slot for engaging said spring-loaded device when in the extended position as the swing arm is rotated in opposite directions towards said fixed position, said ramp surfaces progressively depressing said spring-loaded device towards said retracted position as it is rotated towards said slot, whereby the spring loaded device will extend into said extended position to engage in said slot automatically when aligned with the slot.

23. An exercise arm assembly, comprising:

at least one main arm having a first pivot connection for connection to the frame of an exercise machine to allow pivoting of the main arm about a primary pivot axis;

at least one swing arm pivotally secured to the main arm for rotation about a swing arm pivot axis between outward and inward positions relative to the first pivot connection, and at least one handle associated with the swing arm;

at least one stop on the assembly defining an outer rest position of the swing arm;

the swing arm pivot axis having a downwardly directed angle of inclination relative to a vertical axis of the exercise machine, and being inclined inwardly towards the inward position of the swing arm, such that the swing arm will automatically fall outward into the outer rest position against the stop when released; and the swing arm pivot axis being configured to produce a multi-plane chest to chin exercise movement.

24. The assembly as claimed in claim 23, further comprising a first locking member on the main arm and a second locking member on the swing arm for releasable locking engagement with the first locking member to releasably secure the swing arm in at least one fixed position relative to the main arm.

25. The assembly as claimed in claim 24, further comprising an end plate on the main arm, a pivot member extending from said end plate in a direction away from the main arm to define said swing arm pivot axis, the swing arm pivotally engaging said pivot member, the second locking member comprising a receiving plate on the swing arm at a location spaced from said swing arm pivot axis, the receiving plate having at least one slot defining a fixed position of said swing arm about said pivot axis, and the first locking member being mounted on said main arm end plate for releasable engagement in said slot.

26. The assembly as claimed in claim 25, wherein said receiving plate has a plurality of slots for selective engagement with said first locking member to define a plurality of different fixed positions for said swing arm.

27. The assembly as claimed in claim 24, wherein one of said locking members comprises a receiving plate having at least one slot defining a fixed position of said swing arm, and the other locking member comprises a pull pin having a spring-loaded plunger moveable between an extended position for engagement in said slot and a retracted position to allow free rotation of the swing arm.

28. The assembly as claimed in claim 27, wherein the slot is located in a central region of said plate, and the swing arm is movable between an outward rest position and an inward position when said plunger is retracted, the plate having first and second ramp surfaces extending in opposite directions up to said slot for engaging said plunger when in the extended position as the swing arm is rotated in opposite directions towards said fixed position, said ramp surfaces depressing said plunger as it rotates towards said slot, whereby the plunger will extend into said slot automatically when the pull pin is aligned with the slot.

29. The apparatus as claimed in claim 27, wherein the receiving plate has a plurality of slots defining different fixed positions for said swing arm.

30. The apparatus as claimed in claim 29, wherein the receiving plate has opposite end stops for defining inward and outward positions of said swing arm when said plunger is retracted to allow free rotation of said swing arm.

31. The assembly of claim 23, wherein said one swing arm comprises a first swing arm pivotally associated with a first end portion of the main arm, the assembly further comprising a second swing arm pivotally associated with a second end portion of the main arm for rotation about a second swing arm pivot axis between outward and inward positions relative to the first pivot connection, the second swing arm pivot axis having a downwardly directed angle of inclination which is inclined inwardly towards the first swing arm, and the swing arm pivot axes being non-parallel and intersecting at a location below the first pivot connection.

* * * * *